US011123996B2

(12) United States Patent
Tsuji

(10) Patent No.: US 11,123,996 B2
(45) Date of Patent: Sep. 21, 2021

(54) PRINTING APPARATUS

(71) Applicant: SEIKO EPSON CORPORATION, Tokyo (JP)

(72) Inventor: Akina Tsuji, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/637,563

(22) PCT Filed: Aug. 7, 2018

(86) PCT No.: PCT/JP2018/029571
§ 371 (c)(1),
(2) Date: May 5, 2020

(87) PCT Pub. No.: WO2019/031491
PCT Pub. Date: Feb. 14, 2019

(65) Prior Publication Data

US 2021/0060980 A1 Mar. 4, 2021

(30) Foreign Application Priority Data

Aug. 10, 2017 (JP) ..... JP2017-155112

(51) Int. Cl.
*B41J 2/01* (2006.01)
*B41J 11/00* (2006.01)

(52) U.S. Cl.
CPC ..... *B41J 11/0015* (2013.01)

(58) Field of Classification Search
None
See application file for complete search history.

(56) References Cited

U.S. PATENT DOCUMENTS

| | | | | |
|---|---|---|---|---|
| 5,992,993 | A | 11/1999 | Kiyohara et al. | |
| 7,771,038 | B2 * | 8/2010 | Araya | B41J 13/02 347/101 |
| 9,393,807 | B2 * | 7/2016 | Miyashita | B41J 29/02 |
| 2014/0064815 | A1 * | 3/2014 | Takahata | G03G 15/6558 399/397 |

FOREIGN PATENT DOCUMENTS

| | | |
|---|---|---|
| JP | H03-102035 | 4/1991 |
| JP | H05-147316 | 6/1993 |
| JP | H08-40589 | 2/1996 |
| JP | H10-305635 | 11/1998 |
| JP | 2002-226074 | 8/2002 |
| JP | 2005-145600 | 6/2005 |

* cited by examiner

*Primary Examiner* — Erica S Lin
*Assistant Examiner* — Tracey M McMillion
(74) *Attorney, Agent, or Firm* — Workman Nydegger

(57) ABSTRACT

A printing apparatus includes a printing head that performs printing in a printing region of a first surface of a medium, a support portion that supports a second surface of a medium, a transport unit that transports the medium in a transport direction, and a static electricity eliminating material that is provided facing the second surface and that eliminates, in a non-contact manner with the medium, static electricity accumulated in the medium. The support portion includes a spacer that maintains a predetermined distance between the medium and the static electricity eliminating material.

9 Claims, 16 Drawing Sheets

PRINTING APPARATUS

TECHNICAL FIELD

The disclosure relates to a printing apparatus.

BACKGROUND ART

In related art, a printing apparatus is known that is provided with an electrostatic eliminator that eliminates static electricity in order to suppress adherence of printing paper to a guide or the like due to static electricity accumulated in the printing paper. The electrostatic eliminator is provided with a destaticizing brush, which is disposed so that a tip end portion of the destaticizing brush makes contact with the printing paper being transported, and is further provided with a control device that controls the position of the destaticizing brush (see Patent Document 1, for example).

CITATION LIST

Patent Literature

Patent Document 1: JP-A-10-305635

SUMMARY OF INVENTION

Technical Problem

However, with the electrostatic eliminator described above, the control of the position of the destaticizing brush is complicated, and, because the tip end portion of the destaticizing brush makes contact with the printing paper, as the tip end portion of the destaticizing brush becomes worn, a problem arises in that a destaticizing effect of eliminating the static electricity accumulated in the printing paper deteriorates.

Solution to Problem

The disclosure is intended to address at least some of the above-described problems and can be realized as the following modes or application examples.

[Application Example 1] A printing apparatus according to this application example includes a printing head configured to perform printing in a printing region of a first surface of a medium, a support portion configured to support a second surface of the medium, a transport unit configured to transport the medium in a transport direction, and a static electricity eliminating material provided facing the second surface. The support portion includes a spacer configured to maintain a predetermined distance between the medium and the static electricity eliminating material.

According to this configuration, the second surface of the medium and the static electricity eliminating material face each other through the spacer. In other words, the predetermined distance can be maintained between the medium and the electrostatic removal material without requiring complex control or the like, and static electricity can be eliminated without the static electricity eliminating material coming into contact with the medium. Therefore, wear of the static electricity eliminating material is reduced, and static electricity accumulated in the medium can be reliably eliminated. Then, since the medium is destaticized, transport resistance on the transport unit is reduced, and transport accuracy can be increased.

[Application Example 2] The support portion of the printing apparatus according to the above-described application example includes a medium guide mechanism including a shaft member provided across a width direction orthogonal to the transport direction and configured to guide the medium in the transport direction. The static electricity eliminating material is provided covering a front surface of the shaft member.

According to this configuration, three members, namely, the shaft member, the static electricity eliminating material, and the spacer, function as the single medium guide mechanism. In this way, using a compact structure, a destaticizing effect can be deployed, and at the same time, switching of a transport direction of the medium can be realized.

[Application Example 3] The support unit of the printing apparatus according to the above-described application example includes a platen configured to support at least the printing region, from the second surface side. The medium guide mechanism is provided upstream of the platen in the transport direction.

According to this configuration, the medium guide mechanism is provided upstream of the platen in the transport direction, and thus, the medium in a destaticized state is transported to the platen. In this way, electrostatic attraction of the second surface of the medium to the platen is inhibited, the transport resistance is reduced, and the transport accuracy of the medium can be increased.

[Application Example 4] The spacer of the printing apparatus according to the above-described application examples is provided facing both the second surface and the static electricity eliminating material, and an opening exposing the static electricity eliminating material to the second surface is provided in the spacer.

According to this configuration, because the spacer is provided with the opening exposing the static electricity eliminating material to the second surface, a sliding surface area is reduced when the medium comes into contact with the spacer, compared to a case in which the spacer is a continuous surface, for example. In this way, sliding resistance of the spacer with respect to the shaft member (a medium guide bar) or sliding resistance of the medium with respect to the spacer is reduced, and the medium moves more easily in the width direction. In this way, even when lateral displacement of the medium occurs, for example, since the sliding resistance is small, lateral displacement elimination of the medium can be promoted. Further, due to the opening provided in the spacer, the static electricity eliminating material and the medium can be caused to face each other appropriately while maintaining the predetermined distance between the static electricity eliminating material and the medium, and destaticization can be reliably performed.

[Application Example 5] The printing apparatus according to the above-described application examples further includes a pressing device configured to press the static electricity eliminating material toward the shaft member, through the spacer. When a frictional coefficient between the shaft member and the static electricity eliminating material is a first frictional coefficient, a frictional coefficient between the static electricity eliminating material and the spacer is a second frictional coefficient, and a frictional coefficient between the spacer and the second surface is a third frictional coefficient, the second frictional coefficient is greater than the first frictional coefficient and the third frictional coefficient.

According to this configuration, by pressing, through the spacer, the static electricity eliminating material toward the shaft member, the static electricity eliminating material and the spacer come into close contact with each other. Then, the frictional force (the second frictional force) acting between the static electricity eliminating material and the spacer is a greatest value, and thus, relative rotation between the static electricity eliminating material and the spacer can be suppressed. In other words, the static electricity eliminating material and the spacer are easily rotated simultaneously with respect to the shaft member. In this way, wear of the static electricity eliminating material caused by sliding of the spacer with respect to the static electricity eliminating material can be reduced, and a functional life of the static electricity eliminating material can be further extended.

[Application Example 6] In the printing apparatus according to the above-described application examples, the third frictional coefficient is greater than the first frictional coefficient.

According to this configuration, since the third frictional force is greater than the first frictional force, the third frictional force becomes a driving force due to the transport of the medium. Thus, the spacer and the static electricity eliminating material more easily rotate relative to the shaft member. As a result, the second surface of the medium is less likely to slide relative to the spacer, and the wear of the spacer can therefore be reduced. Thus, accuracy of the distance between the static electricity eliminating material and the second surface of the medium can be appropriately maintained.

[Application Example 7] In the printing apparatus according to the above-described application examples, the third frictional coefficient is less than the first frictional coefficient.

According to this configuration, since the third frictional force is less than the first frictional force, in accordance with the transport of the medium, the relative position of the opening of the spacer with respect to the second surface of the medium changes. In this way, the relative position of a portion of the second surface of the medium not able to face the static electricity eliminating material can be changed to a position at which the second surface of the medium faces the static electricity eliminating material, and thus, static electricity accumulated in the medium can be further eliminated.

[Application Example 8] The spacer of the printing apparatus according to the above-described application examples is provided in a manner of being divided in the width direction.

According to this configuration, when there is torsion or the like in the shaft member due to an assembly error, even if the static electricity eliminating material has projections and depressions following the shape of the torsion of the shaft member, at each of positions at which the spacers are provided in the width direction, it becomes easier for the spacers to conform to the projections and depressions of the static electricity eliminating material and be in close contact with the static electricity eliminating material, and the distance between the medium and the static electricity eliminating material can be uniformly maintained. In this way, it is possible to suppress non-uniformity in the effect of destaticizing the medium in the width direction. Additionally, because each of the spacers provided in a manner of being divided from each other in the width direction can rotate at mutually different circumferential speeds with respect to the shaft member, transport errors of the medium in the width direction can be mitigated.

DESCRIPTION OF EMBODIMENTS

Exemplary embodiments of the disclosure will be described below with reference to the accompanying drawings. Note that, in each of the figures below, to illustrate each of members and the like in a recognizable size, each of the members and the like is illustrated to a scale different from an actual scale.

Embodiment 1

First, a configuration of a printing apparatus will be described. The printing apparatus is, for example, an inkjet printer. In this embodiment, a large format printer (LFP) handling relatively large media (medium), or a grand format printer (GFP) handling even larger media will be described as a configuration example of the printing apparatus.

Figure 1:
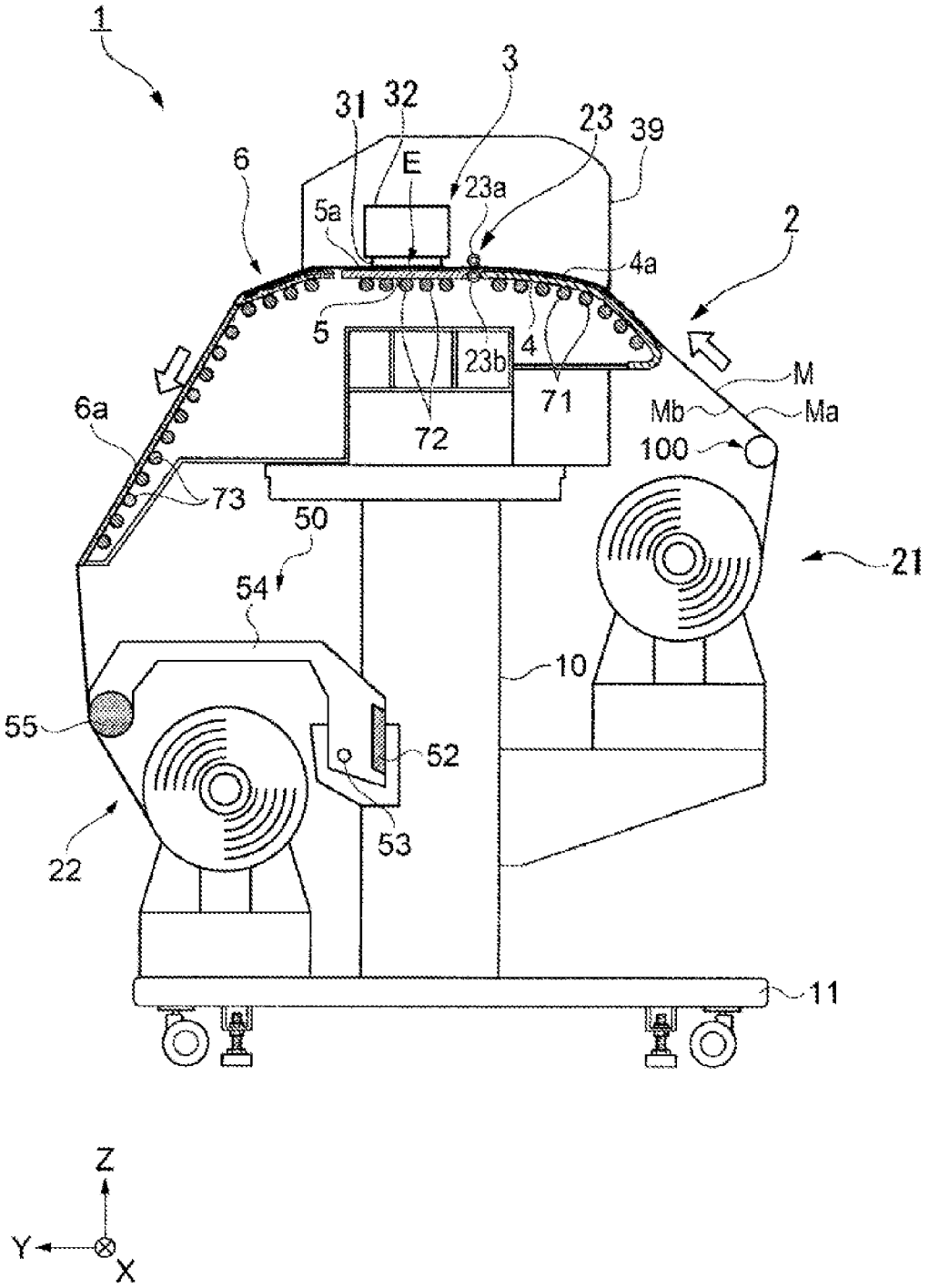
FIG. 1 is a schematic view illustrating a configuration of a printing apparatus according to Embodiment 1.

FIG. 1 is a schematic view (a partial side cross-sectional view) illustrating the configuration of the printing apparatus. As illustrated in FIG. 1, a printing apparatus 1 includes a transport unit 2 that transports a medium M, a printing unit 3 including a printing head 31 that performs printing by ejecting (spraying), as droplets, ink that is an example of a liquid toward a printing region of the medium M, a support portion that supports the medium M, and the like.

Note that the support portion is a concept that includes a first support portion 4, a second support portion 5, a third support portion 6, and a medium guide mechanism 100.

Further, a material of the medium M is not particularly limited, and a paper material, a film material, or the like can be applied.

Further, the printing apparatus 1 is provided with a tension adjustment unit 50 capable of applying tension to the medium M by coming into contact with the medium M. Further, the printing apparatus 1 is provided with a control unit that controls the transport unit 2, the printing unit 3, and the like. Note that, these structural components are supported by a main body frame 10 disposed in a substantially vertical direction. Further, the main body frame 10 is coupled to a base unit 11 supporting the main body frame 10.

The transport unit 2 transports the medium M in a transport direction (a direction of an outlined arrow in FIG. 1). In this embodiment, the medium M is transported by a roll-to-roll method. The transport unit 2 includes a roll unit 21 that feeds out the roll-type medium M in the transport direction, and a roll unit (reel unit) 22 capable of winding the fed-out medium M.

Further, as illustrated in FIG. 1, the medium guide mechanism 100 that supports the medium M is disposed downstream of the roll unit 21 in the transport direction of the medium M. Then, the first support portion 4, which includes a first support face 4*a* that supports the medium M, is disposed downstream of the medium guide mechanism 100 in the transport direction of the medium M, the second support portion 5 is disposed that is provided downstream of the first support portion 4 in the transport direction of the medium M and includes a second support face 5*a* that supports the medium M, and the third support portion 6 is disposed that is provided downstream of the second support portion 5 and includes a third support face 6*a* that supports the medium M. Then, the medium M fed out from the roll unit 21 is transported to the roll unit 22, via the medium guide mechanism 100, the first support portion 4, the second support portion 5, and the third support portion 6. Further, the second support face 5*a* of the second support portion 5 is disposed facing the printing head 31. In other words, the second support face 5*a* is disposed to be capable of supporting the medium M in a printing region E in which ink is ejected from the printing head 31 (the printing unit 3).

Note that in this embodiment, the printing is performed on a first surface Ma of the medium M, and a second surface Mb, which is the opposite surface of the medium M from the first surface Ma, is supported by the support portion (the medium guide mechanism 100, the first support portion 4, the second support portion 5, and the third support portion 6). In other words, in a state in which the first surface Ma of the medium M and the printing head 31 are facing each other (a state in which the second surface Mb of the medium M is supported on the second support face 5*a*), the ink is ejected from the printing head 31 toward the first surface Ma of the medium M, and an image is formed on the first surface Ma.

Further, a pair of transport rollers 23 for transporting the medium M is provided on a transport path of the medium M between the first support portion 4 and the second support portion 5. The pair of transport rollers 23 includes a first roller 23*a* and a second roller 23*b* disposed below the first roller 23*a*. The first roller 23*a* is a driven roller, and the second roller 23*b* is a driving roller. In a state in which the medium M is clamped by the first roller 23*a* and the second roller 23*b*, the medium M is transported along the transport path by the driving of the second roller 23*b*.

Heaters 71 capable of heating the medium M are disposed in the first support portion 4. The heaters 71 in this embodiment are disposed on a surface (back surface) side on an opposite side from the first support face 4*a* of the first support portion 4. Each of the heaters 71 is, for example, a tube heater, and is attached to the back surface of the first support portion 4 using aluminum tape or the like. Then, by driving the heaters 71, the first support face 4*a* supporting the medium M can be heated by heat conduction. Note that, similarly, heaters 72 are also disposed in the second support portion 5, on a surface (back surface) side on an opposite side from the second support face 5*a*. A configuration of the heater 72 is the same as the configuration of the heater 71. Similarly, heaters 73 are also disposed in the third support portion 6, on a surface (back surface) side on an opposite side from the third support face 6*a*. A configuration of the heater 73 is the same as the configuration of the heater 71.

Here, the heaters 71 corresponding to the first support portion 4 preheat the medium M upstream, in the transport direction, of a position at which the printing unit 3 is disposed. By gradually increasing the temperature of the medium M from an ambient temperature toward a target temperature (a temperature at the heaters 72), a configuration is obtained that promotes rapid drying from a time at which the ink lands. The heaters 72 corresponding to the second support portion 5 heats the medium M in the printing region E of the printing unit 3. The heaters 72 cause the medium M to receive the landing of the ink in a state in which the target temperature is maintained, promote the rapid drying from the time at which the ink lands, rapidly dry and fix the ink in the medium M, and prevent bleed-through and feathering, thereby improving image quality. Then, the heaters 73 corresponding to the third support portion 6 can heat the medium M to a temperature higher than the temperature increase by the heaters 71 and the heaters 72, and cause the ink landed on the medium M that has not sufficiently dried to rapidly dry. In this way, the ink landed on the medium M is suitably dried and fixed in the medium M at least before the medium M is wound onto the roll unit 22. Note that the temperature settings and the like of the heaters 71, 72, and 73 can be set appropriately in accordance with the medium M, the ink, or printing conditions.

Note that the heaters 73 corresponding to the third support portion 6 need not necessarily be provided on the opposite face from the third support face 6*a* of the third support portion 6, and the heater 73 may be provided as an external heater at a position facing the third support face 6*a*. In this case, the first surface Ma (printed surface) of the medium M can be directly heated, and the ink applied to the first surface Ma of the medium M can be efficiently dried.

The printing unit 3 records (prints) images, characters, and the like on the medium M. Specifically, the printing unit 3 includes the printing head (inkjet head) 31 capable of ejecting the ink as droplets onto the medium M, and a carriage 32 on which the printing head 31 is mounted and which freely reciprocates in a width direction (X axis direction) of the medium M. Further, the printing apparatus 1 includes a frame body 39, and the printing head 31 and the carriage 32 are disposed inside the frame body 39.

The printing head 31 is provided with nozzles (not illustrated) capable of ejecting droplets, and can cause the nozzles to eject the ink as droplets by driving a piezoelectric element as a driving element. In this way, the images and the like can be recorded (printed) on the medium M. Further, a pressing portion (not illustrated), which presses the medium M supported by the second support face 5*a* to the side of the second support face 5*a* from above (from the side of the first surface Ma), is provided in the printing region E, and the printing head 31 is caused to eject the droplets in a state in which lifting or the like of the medium M on the second support face 5*a* is suppressed. In this way, the droplets are caused to land at a precise position, and the image quality can be improved.

Note that the configuration of the printing head 31 is not limited to the above-described configuration. As a pressure generating device, for example, a so-called electrostatic type actuator or the like, which generates static electricity between a vibration plate and an electrode, deforms the vibration plate using the static electricity, and causes nozzles to eject droplets, may be used. In addition, a droplet ejecting head may be used that is configured to use a heating element to generate bubbles in nozzles, and cause the nozzles to eject the ink as droplets using the bubbles. Further, the pressing portion may press the medium M toward the side of the second support face 5*a* from above (from the side of the first surface Ma) using air pressure, or may press the medium M toward the side of the second support face 5*a* from below (from the side of the second surface Mb) using suction.

The tension adjustment unit 50 can apply tension (tensile force) to the medium M. The tension adjustment unit 50 in this embodiment is disposed so as to be capable of applying the tension (the tensile force) to the medium M between the third support portion 6 and the roll unit 22. The tension adjustment unit 50 is provided with a pair of frame portions 54, and is configured to be capable of rotating around a rotation shaft 53. Further, a tension bar 55 is disposed between respective first ends of the pair of frame units 54. The tension bar 55 is formed to be longer in the width direction (the X axis direction) than a width dimension of the medium M. Then, a configuration is obtained in which a part of the tension bar 55 comes into contact with the medium M and applies the tension to the medium M. Further, a weight portion 52 is disposed between respective second ends of the pair of frame units 54. In this way, by rotating the tension adjustment unit 50 around the rotation shaft 53, the position of the tension adjustment unit 50 can be shifted.

Figure 2:
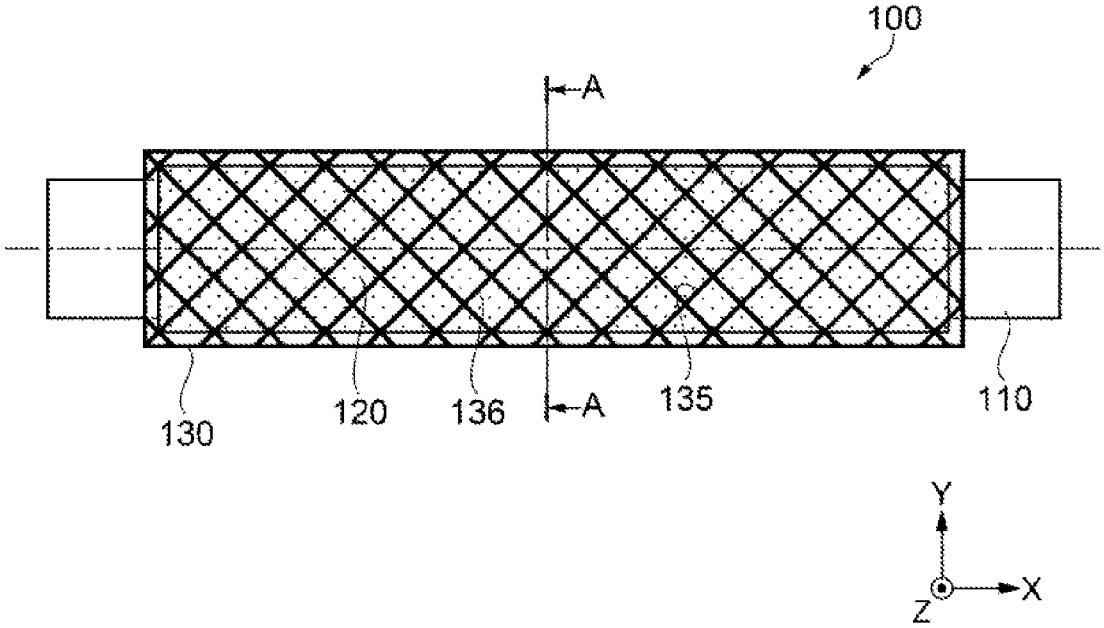
FIG. 2 is a schematic view illustrating a configuration of a support portion (a medium guide mechanism) according to Embodiment 1.
Figure 3:
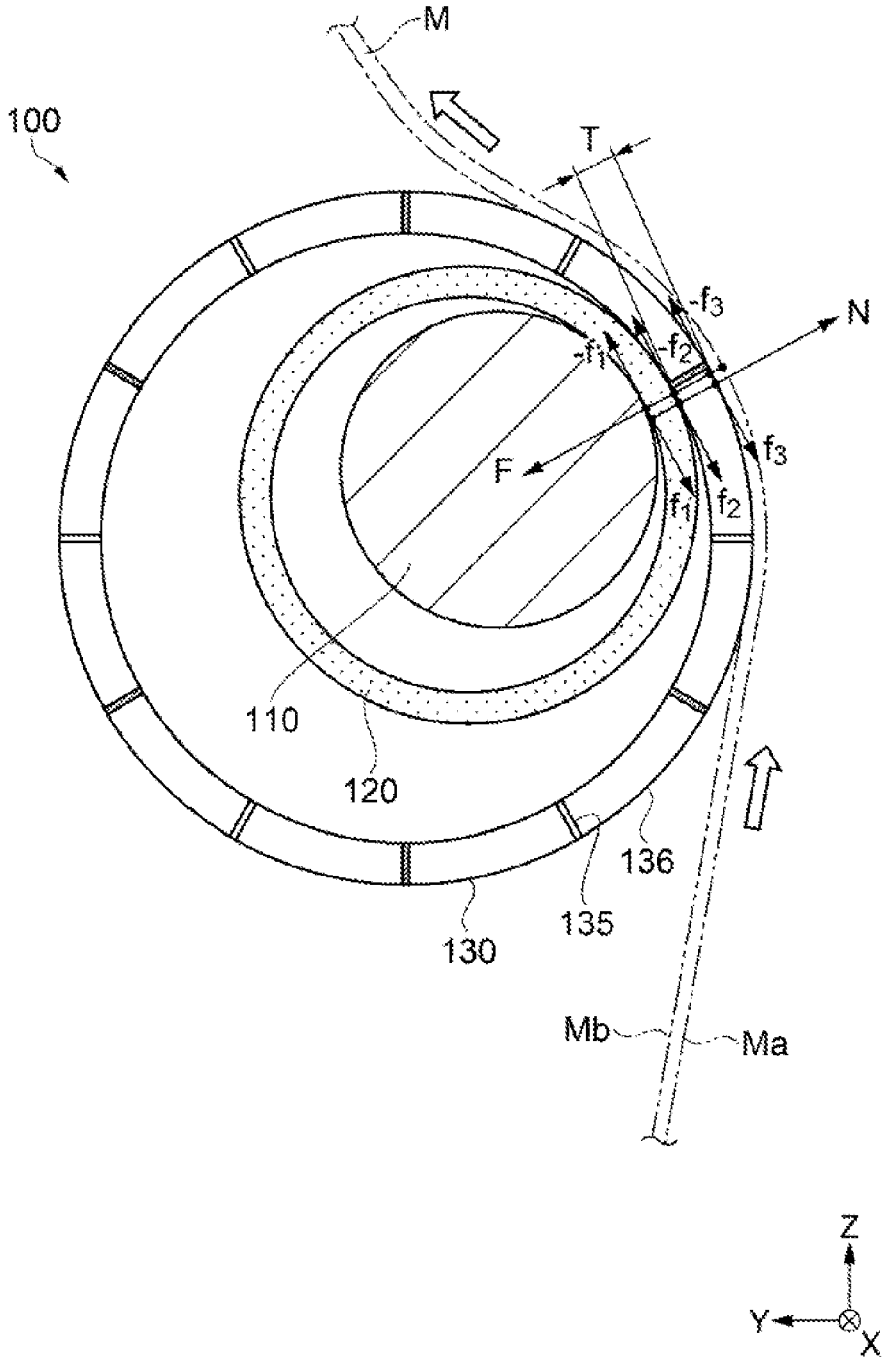
FIG. 3 is a schematic view illustrating the configuration of the support portion (the medium guide mechanism) according to Embodiment 1.

Next, a configuration of the medium guide mechanism 100 will be described. FIG. 2 and FIG. 3 are schematic views of a configuration of the medium guide mechanism. FIG. 2 is a plan view, and FIG. 3 is a cross-sectional view taken along a line A-A in FIG. 2.

As illustrated in FIG. 2 and FIG. 3, the medium guide mechanism 100 includes a shaft member 110 that is provided across the width direction (the X axis direction) orthogonal to the transport direction of the medium M, and that guides the medium M in the transport direction, a static electricity eliminating material 120 provided covering the front surface of the shaft member 110, and a spacer 130 provided over the front surface of the static electricity eliminating material 120.

The shaft member 110 forms a cylindrical shape (rod shape). A length dimension of the shaft member 110 in an axial direction (the X direction) is formed so as to be longer than the width dimension (a dimension along the X axis) of the medium M being transported. The shaft member 110 is formed from a metal material, such as iron, for example. The outer circumferential surface of the shaft member 110 has a smooth surface. Then, the shaft member 110 is fixed so as not to rotate around an axial center thereof.

The static electricity eliminating material 120 is a member capable of eliminating, in a non-contact manner, static electricity built up (accumulated) in the transported medium M. The static electricity eliminating material 120 is a non-woven fabric formed from nylon fibers, polyester fibers, and the like. Then, a fiber tip end portion of the front surface of the static electricity eliminating material 120 serves as a conductor rod, and when the charged medium M is brought close to the static electricity eliminating material 120, the medium M can be destaticized by corona discharge, in a non-contact state with respect to the medium M. To enhance the effect of destaticizing the medium M by the static electricity eliminating material 120, it is preferable to maintain a distance between the static electricity eliminating material 120 and the medium M to be from 0.5 mm to 4 mm.

The static electricity eliminating material 120 is provided so as to face the second surface Mb of the medium M. In this embodiment, the static electricity eliminating material 120 is cylindrical and covers the outer circumferential surface of the shaft member 110. As a result, the static electricity eliminating material 120 and the second surface Mb of the medium M can face each other. A length dimension of the static electricity eliminating material 120 in the X axis direction is formed so as to be longer than the width dimension (the dimension along the X axis) of the medium M being transported. Further, the shaft member 110 and the static electricity eliminating material 120 are not fixed to each other, and the static electricity eliminating material 120 is configured to be rotatable relative to the shaft member 110. Further, at least a portion of the static electricity eliminating material 120 and the shaft member 110 are in contact with each other having a first coefficient of friction $\mu 1$.

The spacer 130 is a member that maintains a predetermined distance between the medium M and the static electricity eliminating material 120. In this embodiment, the spacer 130 is provided covering the front surface of the static electricity eliminating material 120. The spacer 130 is formed in a cylindrical shape and is made of a plastic resin or the like, for example. A thickness T of the spacer 130 is uniform. Further, more specifically, the thickness T of the spacer 130 is set to a thickness from 1 mm to 4 mm. In this way, a constant distance can be maintained between the medium M and the static electricity eliminating material 120. Further, by forming the spacer 130 using the plastic resin, damage to the medium M can be inhibited in comparison to when a metal is used. Note that "the constant distance can be maintained between the medium M and the static electricity eliminating material 120", as referred to here, indicates a state in which the medium M and the static electricity eliminating material 120 are maintained at a substantially constant distance from each other, at a plurality of points in a region over which the static electricity in the medium M can be eliminated. This is also true for "maintaining the medium M and the static electricity eliminating material 120 at a constant distance from each other".

A length dimension of the spacer 130 in the X axis direction is the same as the dimension of the static electricity eliminating material 120, and is formed so as to be longer than the width dimension (the dimension along the X axis) of the medium M being transported. Further, the spacer 130 is not fixed to the shaft member 110, and the spacer 130 is configured to be movable (rotatable) around the axial center relative to the shaft member 110. In addition, an inner diameter of the spacer 130 is formed so as to be larger than an outer diameter of the static electricity eliminating material 120 having the shaft member 110 as an axial center thereof in a state in which the static electricity eliminating material 120 covers the shaft member 110. The static electricity eliminating material 120 and the spacer 130 are not adhered and fixed to each other, and the spacer 130 is configured to be rotatable relative to the static electricity eliminating material 120.

Further, the spacer 130 is provided so as to face both the second surface Mb of the medium M and the static electricity eliminating material 120, and openings 135 are provided in the spacer 130 so that the static electricity eliminating material 120 is exposed to the medium M. Specifically, as illustrated in FIG. 2, the spacer 130 is provided with the plurality of rectangular openings 135 that are continuous in the X axis direction and the Y axis direction in plan view. Each of the openings 135 in this embodiment has the same size. Then, in plan view, portions other than the openings 135 of the spacer 130 (non-open portions) serve as a support face 136 that supports the medium M.

Because the openings 135 are provided in the spacer 130, the destaticizing can be reliably performed by causing the static electricity eliminating material 120 to face the second surface Mb of the medium M while keeping the distance between the static electricity eliminating material 120 and the medium M constant. Further, by forming the openings 135, it is possible to reduce a sliding resistance when the medium M comes into contact with the spacer 130. In this case, the openings 135 are formed so that a total area of the openings 135 in plan view is greater than a total area of the support face 136. In this way, the sliding resistance of the medium M with respect to the spacer 130 can be further reduced, and transportability of the medium M can be improved. Further, by also reducing the sliding resistance in the width direction, when lateral displacement of the medium M has occurred, it is possible to suppress the medium M from being transported in a state in which the displacement of the medium M in the width direction is maintained. As a result, eliminating lateral displacement of the medium M by a lateral displacement eliminating mechanism (not illustrated) can be promoted. Further, at least a portion of the spacer 130 is in contact with the static electricity eliminating material 120 while having a second coefficient of friction μ2, at the same time as being in contact with the medium while having a third coefficient of friction μ3.

Further, as illustrated in FIG. 1, the medium guide mechanism 100 is provided upstream, in the transport direction, of the second support portion 5 (corresponding to the platen) that supports the printing region E from the side of the second surface. In this embodiment, the medium guide mechanism 100 is disposed upstream of the second support portion 5 in the transport direction, between the first support portion 4 and the roller unit 21. As a result, the medium M that has been destaticized in advance is transported to the first support portion 4. In other words, the medium M is transported from the roll unit 21 to the first support portion 4 side via the medium guide mechanism 100. Therefore, the medium M that has been destaticized by the medium guide mechanism 100 is transported to the first support portion 4 side, and thus, electrostatic attraction of the medium M with respect to the first support face 4*a* and the second support face 5*a* is inhibited, transport resistance is reduced, and transport accuracy is enhanced.

Figure 4:
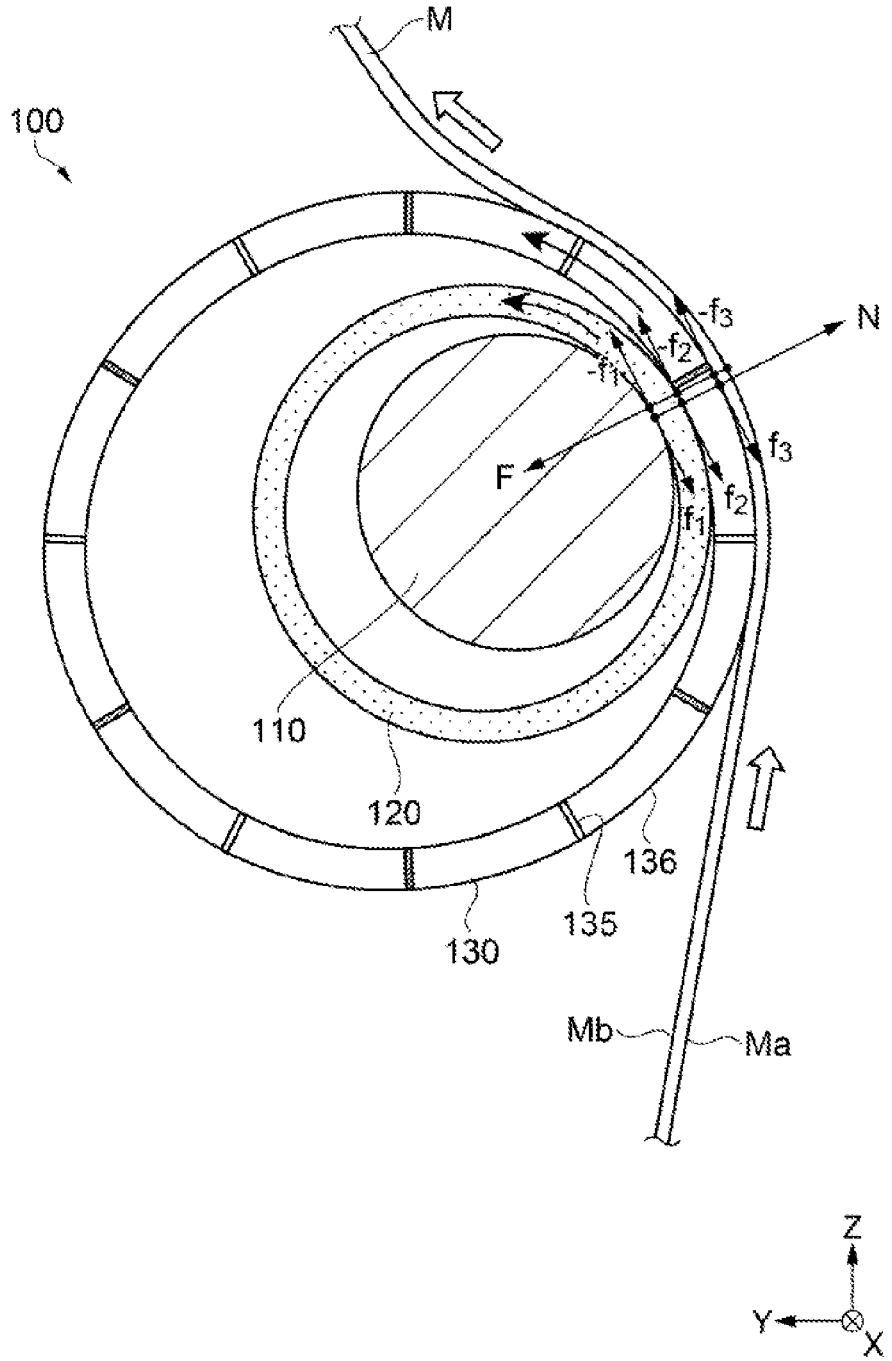
FIG. 4 is a schematic view illustrating operations of the printing apparatus according to Embodiment 1.

Further, in the printing apparatus 1, a pressing device for pressing the static electricity eliminating material 120 toward the shaft member 110, through the spacer 130, is provided. In this embodiment, the pair of transport rollers 23 and the roll unit 21 are provided as the pressing device. Tension (tensile force) is applied to the transported medium M by the pair of transport rollers 23 and the roll unit 21. Then, the tension is also applied to the medium M supported by the medium guide mechanism 100 disposed on the transport path of the medium M. In addition, the pressing device may have a configuration in which the tension adjustment unit 50 is provided between the pair of transport rollers 23 and the roll unit 21. This embodiment is a mode in which the medium guide mechanism 100 supports the second surface Mb of the medium M, the medium M is pressed toward the shaft member 110, and a predetermined load F is applied. As a result, the spacer 130 is pressed from the medium M side, and the spacer 130 presses the static electricity eliminating material 120 toward the shaft member 110. In this way, the static electricity eliminating material 120 is pressed toward the shaft member 110. As a result, a resistant force N is generated (F+N=0) with which the shaft member 110 pushes back the medium M in the direction opposite to the predetermined load F. At this time, a state of relative rotation of the static electricity eliminating material 120 and the spacer 130 with respect to the shaft member 110 or the medium M changes, depending on respective magnitude relationships of the first coefficient of friction μ1 between the shaft member 110 and the static electricity eliminating material 120, the second coefficient of friction μ2 between the static electricity eliminating material 120 and the support face 136 of the spacer 130, and the third coefficient of friction μ3 between the support face 136 of the spacer 130 and the second surface Mb of the medium M. At this time, the second coefficient of friction μ2 is preferably greater than the first coefficient of friction μ1 and the second coefficient of friction μ2 is preferably greater than the third coefficient of friction μ3. That is, the second coefficient of friction μ2 is preferably greater than both the first coefficient of friction μ1 and the third coefficient of friction μ3 (is preferably the greatest value among all the coefficients of friction). In this way, since a second frictional force f2 (that is, the second coefficient of friction μ2 multiplied by the resistant force N) acting between the static electricity eliminating material 120 and the spacer 130 and a second frictional force −f2 resulting from a reaction thereto (that is, the second coefficient of friction μ2 multiplied by the predetermined load F, which is coefficient of friction μ2 multiplied by the −resistant force N) are maximized, the static electricity eliminating material 120 and the spacer 130 are less likely to be displaced. As a result, for example, when the third coefficient of friction μ3 is greater than the first coefficient of friction μ1, as illustrated in FIG. 4, in the transporting of the medium M, the static electricity eliminating material 120 and the spacer 130 can be rotated with respect to the shaft member 110 at substantially the same angular velocity as each other. Therefore, sliding wear between the static electricity eliminating material 120 and the spacer 130 is reduced, and the functional life of the static electricity eliminating material 120 can be further extended. Hereinafter, the second frictional force f2, and the second frictional force −f2 resulting from the reaction thereto, are simply referred to as the "second frictional force" because, of the frictional force acting between the static electricity eliminating material 120 and the spacer 130, it is merely that the frictional force acting on the side of the spacer 130 is arbitrarily determined to be denoted as positive.

Note that the third coefficient of friction μ3 becomes a different value depending on the material of the spacer 130 and the material of the medium M. Further, when n is one of 1, 2 or 3, hereinafter, an n-th frictional force −fn resulting from a reaction to an n-th frictional force fn is an n-th coefficient of friction μn multiplied by the predetermined load F, which is the n-th coefficient of friction μn multiplied by the −resistant force N.

Next, operations of the printing apparatus 1 will be described. FIG. 1 and FIG. 4 are schematic views illustrating the operations of the printing apparatus 1. Specifically, operations around the medium guide mechanism 100 will be mainly described. The medium M is transported from the roll unit 21 to the first support portion 4 side via the medium guide mechanism 100.

The medium M transported to the medium guide mechanism 100 is transported while being pressed against the surface 136 (the outermost circumferential surface) of the spacer 130 toward the shaft member 110.

The spacer 130 is provided with the openings 135 (the portions other than the support face 136), and the medium M is transported in a state in which the second surface Ma of the medium M faces the static electricity eliminating material 120 while the constant distance therebetween is maintained, via the spacer 130. Then, when the second surface Mb of the medium M and the static electricity eliminating material 120 face each other, the static electricity accumulated in the second surface Mb of the medium M is eliminated through corona discharge. Further, because the spacer 130 is provided with the plurality of rectangular openings 135 that are continuous in the X axis direction and the Y axis direction in plan view, the second surface Mb of the medium M faces the static electricity eliminating material 120 when the medium M transports the support surface 136 of the spacer 130, and thus, the static electricity generated in the second surface Mb of the medium M is eliminated.

Further, because the medium M presses the support face 136 (the outermost circumferential surface) of the spacer 130 toward the shaft member 110, the spacer 130 and the static electricity eliminating material 120 are also pressed toward the shaft member 110, and the predetermined load F is applied. In this case, the resistant force N is generated by which the shaft member 110 pushes back on the medium M in the direction opposite to the predetermined load F. At this time, as the result of the respective magnitude relationships of the first coefficient of friction μ1 between the shaft member 110 and the static electricity eliminating material 120, the second coefficient of friction μ2 between the static electricity eliminating material 120 and the spacer 130, and the third coefficient of friction μ3 between the spacer 130 and the second surface Mb of the medium M, the state of relative rotation, arising from the transport of the medium M, of the static electricity eliminating material 120 and the spacer 130 with respect to the shaft member 110 or the medium M changes. Here, in relation to the magnitude relationship between the first coefficient of friction μ1 and the third coefficient of friction μ3, respective cases will be described in detail, with reference to FIG. 3 and FIG. 4, in which the third coefficient of friction μ3 is greater than the first coefficient of friction μ1, and in which the third coefficient of friction μ3 is smaller than the first coefficient of friction μ1.

First, when the third coefficient of friction μ3 is greater than the first coefficient of friction μ1, the frictional force −f1 resulting from the reaction to the first frictional force f1 (that is, the first coefficient of friction μ1 multiplied by the resistant force N) acting between the static electricity eliminating material 120 and the shaft member 110 is smaller than a third frictional force −f3 resulting from a reaction to the third frictional force f3 acting between the second surface Mb of the medium M and the spacer 130 (that is, the third coefficient of friction μ3 multiplied by the resistant force N). In other words, the slipperiness of the second surface Mb of the medium M relative to the spacer 130, is less than the slipperiness of the static electricity eliminating material 120 relative to the shaft member 110 (that is, is less likely to slip). As a result, the frictional force −f3 resulting from the reaction to the third frictional force f3 due to the transport of the medium M becomes a driving force, and, as illustrated in FIG. 4, the spacer 130 and the static electricity eliminating material 120 more easily rotate in the counterclockwise direction with respect to the shaft member 110. As a result, the second surface Mb of the medium M is less likely to slide relative to the spacer 130, so wear of the spacer 130 can be reduced, and the accuracy of the distance between the static electricity eliminating material 120 and the second surface Mb of the medium M can be appropriately maintained. In this case, relative positions of the openings 135 of the spacer 130 do not substantially change with respect to the second surface Mb of the medium M. As described above, the openings 135 are preferably formed so that the total area of the openings 135 in plan view is greater than the total area of the support face 136. In this way, the static electricity accumulated in the medium M can be eliminated even when the relative positions of the openings 135 of the spacer 130 with respect to the second surface Mb of the medium M do not substantially change. At this time, the second coefficient of friction μ2 is preferably greater than the first coefficient of friction μ1 and the second coefficient of friction μ2 is preferably greater than the third coefficient of friction μ3. That is, the second coefficient of friction μ2 is preferably greater than the first coefficient of friction μ1 and the third coefficient of friction μ3 (is preferably the greatest value among all the coefficients of friction). In this way, the second frictional force f2 (that is, the second coefficient of friction μ2 multiplied by the resistant force N) acting between the spacer 130 and the static electricity eliminating material 120 is greater than the first frictional force f1 and the third frictional force f3. As a result, in accordance with the transport of the medium M, the spacer 130 and the static electricity eliminating material 120 rotate together in one direction (the counterclockwise direction in FIG. 4) with respect to the shaft member 110, without rubbing together. In this way, the static electricity eliminating material 120 and the spacer 130 can be rotated at substantially the same angular velocity with respect to the shaft member 110, in the transport of the medium M. Therefore, sliding wear between the static electricity eliminating material 120 and the spacer 130 is reduced, and the functional life of the static electricity eliminating material 120 can be further extended.

Next, when the third coefficient of friction μ3 is smaller than the first coefficient of friction μ1, the frictional force −f1 resulting from the reaction to the first frictional force f1 (that is, the first coefficient of friction μ1 multiplied by the resistant force N) acting between the static electricity eliminating material 120 and the shaft member 110 is larger than the third frictional force −f3 resulting from the reaction to the third frictional force f3 acting between the second surface Mb of the medium M and the spacer 130 (that is, the third coefficient of friction μ3 multiplied by the resistant force N). In other words, the slipperiness of the second surface Mb of the medium M relative to the spacer 130, is greater than the slipperiness of the static electricity eliminating material 120 relative to the shaft member 110 (that is, is more likely to slip). In this way, the spacer 130 and the static electricity eliminating material 120 are less likely to rotate relative to the shaft member 110 in accordance with the transport of the medium M. In this case, in comparison to the case in which the third coefficient of friction μ3 is greater than the first coefficient of friction μ1 described above, in accordance with the transport of the medium M, the relative positions of the openings 135 of the spacer 130 with respect to the second surface Mb of the medium M change, as illustrated in FIG. 3. As a result of changing the relative positions, with respect to portions of the second surface Mb of the medium M not able to face the static electricity eliminating material 120 (that is, portions of the second surface Mb at which the spacer 130 is between the second surface Mb of the medium M and the static electricity eliminating material 120 and which are supported by the support surface 136), since, in accordance with the transport of the medium M, the relative positions can be changed to positions at which the second surface Mb of the medium M faces the static electricity eliminating material 120, the static electricity accumulated in the medium M can be further eliminated. Even in this case, the second coefficient of friction μ2 is preferably greater than the first coefficient of friction μ1 and the second coefficient of friction μ2 is preferably greater than the third coefficient of friction μ3. That is, the second coefficient of friction μ2 is preferably greater than the first coefficient of friction μ1 and the third coefficient of friction μ3 (is preferably the greatest value among all the coefficients of friction). In this way, the second frictional force f2 (that is, the second coefficient of friction μ2 multiplied by the resistant force N) acting between the spacer 130 and the static electricity eliminating material 120 is greater than the first frictional force f1 and the third frictional force f3. As a result, in accordance with the transport of the medium M, the spacer 130 and the static electricity eliminating material 120 rotate together in the one direction (the counterclockwise direction in FIG. 4) relative to the shaft member 110. In this way, the static electricity eliminating material 120 and the spacer 130 can be rotated at substantially the same angular velocity with respect to the shaft member 110, in the transport of the medium M. Therefore, sliding wear between the static electricity eliminating material 120 and the spacer 130 is reduced, and the functional life of the static electricity eliminating material 120 can be further extended.

Further, the openings 135 of the spacer 130 reduce a sliding area between the spacer 130 and the medium M. In this way, the sliding resistance in the width direction of the medium M with respect to the spacer 130 is reduced, and, even if the lateral displacement or the like of the medium M has occurred, elimination of the lateral displacement of the medium M by the lateral displacement eliminating mechanism (not illustrated) is promoted, and the medium M is transported to the first support portion 4 side in a state in which the lateral displacement is more easily eliminated.

The medium M with the destaticized second surface Mb is transported on the first support portion 4. In this way, the second surface Mb of the medium M is transported to the second support portion 5 side without being electrostatically attracted to the first support face 4*a* of the first support portion 4, and the printing is performed on the first surface Ma of the medium M in the printing region E of the second support portion 5.

According to this embodiment, as described above, the following effects can be obtained.

The medium guide mechanism 100 is configured by the three members, namely, the shaft member 110, the static electricity eliminating material 120, and the spacer 130, being integrated with each other. In this way, the static electricity accumulated in the second surface Mb of the medium M can be eliminated while the distance between the medium M and the static electricity eliminating material 120 is kept constant, with a compact structure and without requiring complex control or the like. Further, because the static electricity eliminating material 120 and the medium M do not come into contact with each other, sliding of the medium M with respect to the static electricity eliminating material 120 can be suppressed and wear of the static electricity eliminating material 120 can be reduced.

Embodiment 2

Next, Embodiment 2 will be described.

Figure 5:
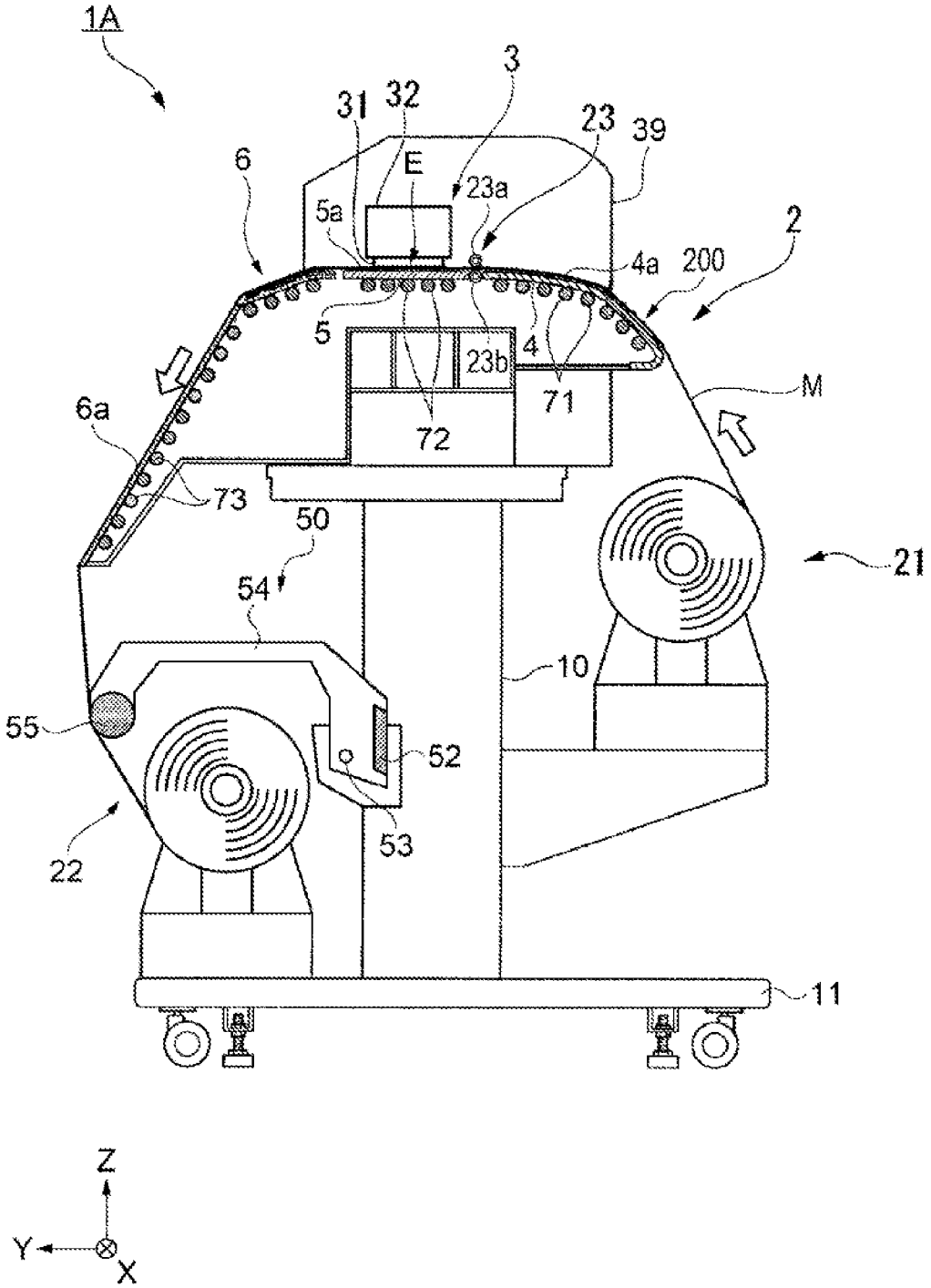
FIG. 5 is a schematic view illustrating a configuration of a printing apparatus according to Embodiment 2.

FIG. 5 is a schematic view illustrating a configuration of a printing apparatus according to this embodiment. As illustrated in FIG. 5, a printing apparatus 1A is provided with the transport unit 2 that transports the medium M, the printing unit 3 including the printing head 31 that performs the printing by ejecting (spraying), as droplets, the ink that is the example of the liquid toward the printing region of the medium M, the support portion that supports the medium M, and the like.

Note that the support portion according to this embodiment is a concept that includes the first support portion 4, the second support portion 5, and the third support portion 6.

In the printing apparatus 1A according to this embodiment, a static electricity eliminating portion 200 is provided on the first support portion 4. The static electricity eliminating portion 200 includes a static electricity eliminating material 220 and a spacer 230 provided on the first support portion 4 (see FIG. 6).

Note that, apart from the fact that the medium guide mechanism 100 is not included and the configuration of the static electricity eliminating material 220 and the spacer 230 in the first support portion 4, the configuration is the same as that of Embodiment 1, and a description thereof will thus be omitted here.

Next, the configuration of the static electricity eliminating portion 200, that is, the configuration of the static electricity eliminating material 220 and the spacer 230 (the static electricity eliminating portion 200) in the first support portion 4, will be described.

Figure 6:
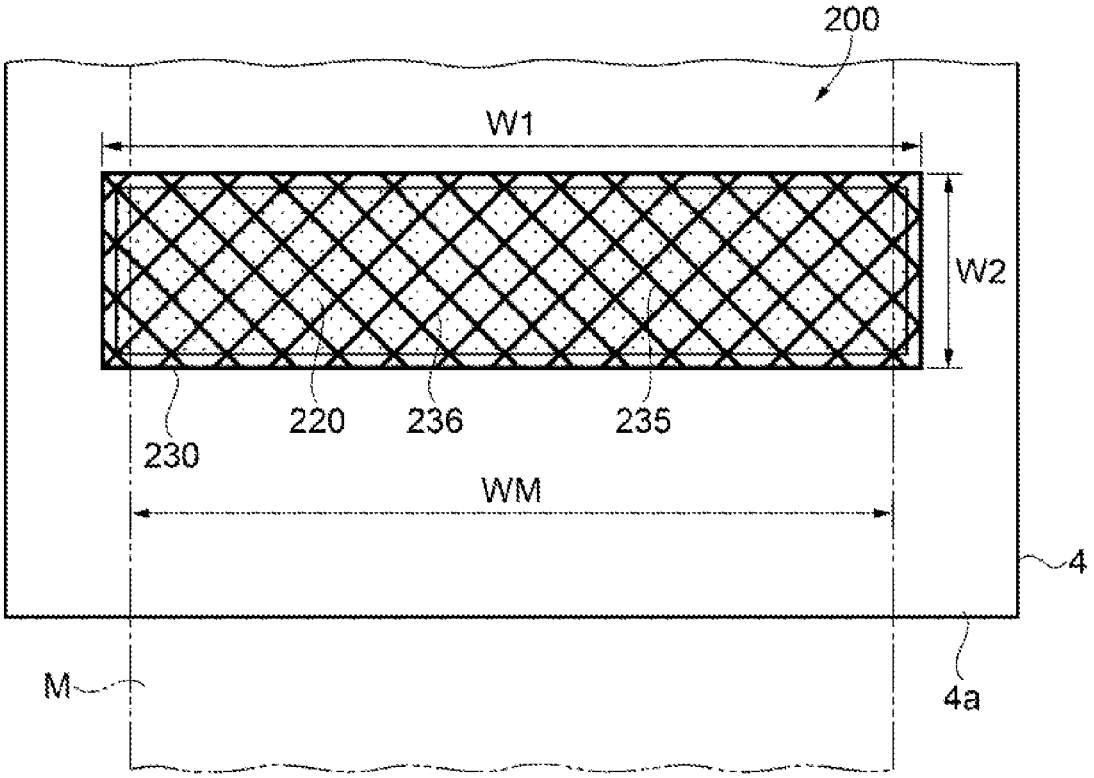
FIG. 6 is a schematic view illustrating a configuration of the support portion (the first support portion) according to Embodiment 2.
Figure 7:
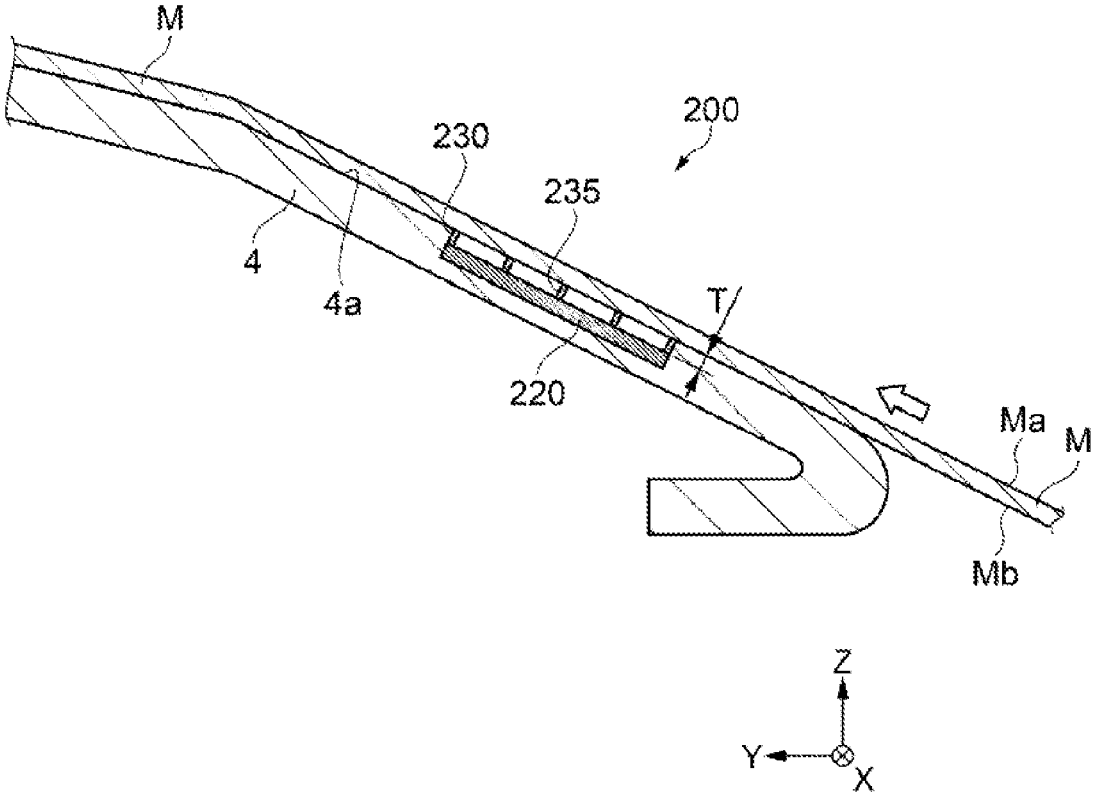
FIG. 7 is a schematic view illustrating a configuration of the support portion (the first support portion) according to Embodiment 2.

FIG. 6 and FIG. 7 are schematic diagrams illustrating the configuration of the first support portion. As illustrated in FIG. 6 and FIG. 7, the static electricity eliminating material 220 and the spacer 230 are disposed in the first support portion 4.

The static electricity eliminating material 220 is a member capable of eliminating static electricity accumulated in the transported medium M from the medium M in a non-contact manner. Note that the material and the like of the static electricity eliminating material 220 are the same as those of Embodiment 1.

A recessed portion is provided in the first support face 4*a* side of the first support portion 4, and the static electricity eliminating material 220 is provided over the entire surface of a bottom portion of the recessed portion. In this embodiment, the recessed portion is rectangular in plan view, and the shape of the static electricity eliminating material 220 disposed in the bottom portion of the recessed portion also has a rectangular shape.

A length dimension W1, in a direction orthogonal to the transport direction of the medium M, of the recessed portion provided in the first support portion 4 is formed to be longer than a width dimension (a dimension along the X axis) WM of the medium M being transported. Therefore, the length dimension W1, in the direction orthogonal to the transport direction of the medium M, of the static electricity eliminating material 220 disposed in the bottom portion of the recessed portion is longer than the width dimension (the dimension along the X axis) WM of the medium M being transported. In addition, a length dimension W2, in the transport direction of the medium M, of the recessed portion provided in the first support portion 4 is approximately ⅓ to half the width dimension (the dimension along the X axis) of the medium M being transported.

In this way, the static electricity accumulated in the second surface Mb of the transported medium M can be reliably eliminated.

The spacer 230 is a member that maintains a predetermined distance between the medium M and the static electricity eliminating material 220. In this embodiment, the spacer 230 is provided covering the front surface of the static electricity eliminating material 220. The spacer 230 is formed in a plate shape using, for example, a plastic resin or the like. The thickness T of the spacer 230 is uniform. Further, the specific thickness T of the spacer 230 is set to be from 1 mm to 4 mm. Then, the spacer 230 is mounted on the static electricity eliminating material 220 disposed in the bottom portion of the recessed portion of the first support portion 4. The size of the spacer 230 in plan view is substantially the same as the size of the recessed portion of the first support portion 4 in plan view. Further, a top surface (a support face 236) of the spacer 230 and the first support face 4*a* of the first support portion 4 are configured to be flush with each other. In this way, it is difficult for steps to be formed in the surface that supports the medium M on the transport path, and the medium M is not easily damaged during transport.

In addition, openings 235 are provided in the spacer 230 so that the static electricity eliminating material 220 is exposed to the medium M. Specifically, the spacer 230 is provided with the plurality of rectangular openings 235 that are continuous in a direction orthogonal to the transport direction and in the transport direction of the medium M in plan view. Each of the openings 235 in this embodiment has the same size. Then, in plan view, portions other than the openings 235 of the spacer 230 serve as the support face 236 that supports the medium M.

Because the openings 235 are provided in the spacer 230, the static electricity generated in the second surface Mb can be reliably eliminated, when the static electricity eliminating material 220 is caused to face the second surface Mb of the medium M while keeping the distance between the static electricity eliminating material 220 and the medium M constant. Further, the sliding resistance can also be reduced when the medium M comes into contact with the spacer 230. In this case, a total area of the openings 235 in plan view is formed to be larger than a total area of the support face 236. In this way, the sliding resistance of the medium M with respect to the spacer 230 can be further reduced, and the transportability of the medium M can be improved. Further, by improving the transportability of the medium M, the elimination of the lateral displacement of the medium M can be promoted.

Also, as illustrated in FIG. 5, the static electricity eliminating portion 200 is provided upstream, in the transport direction, of the second support portion 5 (corresponding to the platen) supporting the medium M by being in contact with the second surface Mb in the printing region E. In this embodiment, the static electricity eliminating portion 200 is disposed in the first support portion 4, which is provided upstream of the second support portion 5 in the transport direction. In this way, the medium M is transported to the second support portion 5 with the second surface Mb in a destaticized state. Therefore, electrostatic attraction of the medium M to the first support face 4*a* and the second support face 5*a* downstream of the static electricity eliminating portion 200 in the transport direction is inhibited, the transport resistance is reduced, and the transport accuracy is enhanced.

Next, operations of the printing apparatus 1A will be described. Specifically, operations around the static electricity eliminating portion 200 will be mainly described. The medium M is transported from the roll unit 21 to the first support portion 4 side. Then, as illustrated in FIG. 6 and FIG. 7, the medium M transported to the first support portion 4 is transported in a state of being supported by the support face 236 of the spacer 230 provided on the first support portion 4.

The spacer 230 is provided with the openings 235 (the portions other than the support face 236), and the medium M is transported in a state in which the second surface Mb of the medium M faces the static electricity eliminating material 220 while the constant distance therebetween is maintained, via the spacer 230. Then, when the second surface Mb of the medium M and the static electricity eliminating material 220 face each other, the static electricity accumulated in the second surface Mb of the medium M is eliminated through corona discharge. Further, because the spacer 230 is provided with the plurality of rectangular openings 235 that are continuous in the direction orthogonal to the transport direction and in the transport direction of the medium M in plan view, the second surface Mb of the medium M faces the static electricity eliminating material 220 when the medium M is transported while being supported by the support surface 236 of the spacer 230, and thus, the static electricity generated in the second surface Mb of the medium M is eliminated. Further, since the first support face 4*a* of the first support portion 4 and the support face 236 of the spacer 230 are configured to be flush with each other, level differences in the surface supporting the medium M on the transport path are eliminated, the medium M is not easily damaged during transport, and smooth transportation is thus implemented. Then, the medium M is transported to the first support face 4*a* of the first support portion 4 positioned downstream, in the transport direction, of the position at which the static electricity eliminating material 220 in a state in which the second surface Mb of the medium M is destaticized. In this way, on the first support face 4*a* of the first support portion 4 positioned downstream, in the transport direction, of the position at which the static electricity eliminating material 220 is disposed, the medium M is transported to the second support portion 5 side without electrostatic attraction of the second surface Mb of the medium M, and printing is performed on the medium M in the printing region E of the second support portion 5.

According to this embodiment, the following effects can be obtained.

By providing the static electricity eliminating portion 200 (the static electricity eliminating material 220 and the spacer 230) in the first support portion 4, static electricity accumulated in the second surface Mb of the medium M can be eliminated with a simple configuration.

Note that the disclosure is not limited to the above-described embodiments, and various modifications and improvements can be made to the above-described embodiments. Modified examples will be described below.

Figure 8:
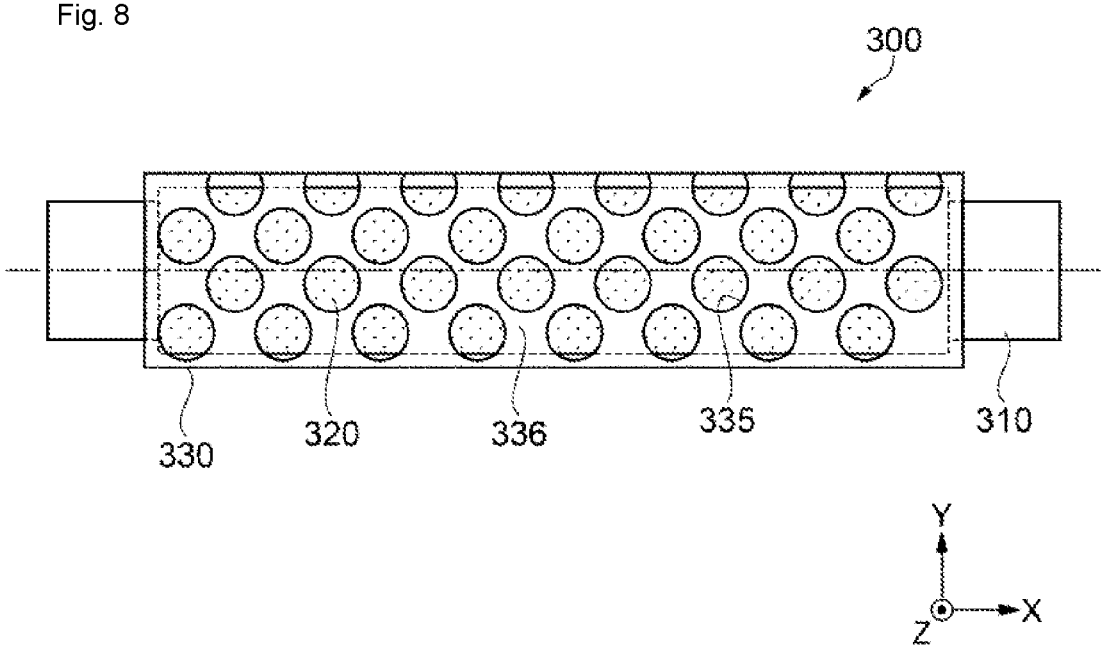
FIG. 8 is a schematic view illustrating a configuration of the support portion according to Modified Example 1.

(Modified Example 1) In Embodiment 1, the shape of the opening 135 is rectangular, but the shape is not limited thereto. For example, the shape of the opening may be circular. FIG. 8 is a schematic view illustrating a configuration of the support portion (a medium guide mechanism) according to this modified example.

As illustrated in FIG. 8, a medium guide mechanism 300 includes a shaft member 310 that is provided across the width direction (the X axis direction) orthogonal to the transport direction of the medium M, and that guides the medium M in the transport direction, a static electricity eliminating material 320 provided covering the front surface of the shaft member 310, and a spacer 330 provided covering the front surface of the static electricity eliminating material 320. Note that the configuration of the shaft member 310 and the static electricity eliminating material 320 is the same as the configuration of Embodiment 1, and a description thereof will thus be omitted here.

The spacer 330 is a member that maintains a predetermined distance between the medium M and the static electricity eliminating material 320. As illustrated in FIG. 8, the spacer 330 is provided with a plurality of circular openings 335 that are continuous in the X axis direction and the Y axis direction in plan view. Then, portions other than the openings 335 of the spacer 330 serve as a support face 336 that supports the medium M. Each of the openings 335 in this modified example has the same size. Further, the openings 335 are arranged in a staggered manner. In other words, the plurality of openings 335 are provided so that the support face 336 does not extend continuously in at least the Y axis direction (the transport direction). Here, the "Y axis direction" refers to a concept that includes not only an orthogonal coordinate system, but also a circumferential direction of a spacer 430 (i.e., a cylindrical coordinate system). In this way, when the medium M is transported on the support face 336 of the spacer 330, the second surface Mb of the medium M faces the static electricity eliminating material 320 without any margin, and therefore, static electricity accumulated in the second surface Mb of the medium M is eliminated. Thus, with the configuration of this modified example also, similar effects as those described above can be obtained. Note that the configuration of the material of the spacer 330 and the like is the same as that of Embodiment 1. Further, the shape of the opening 335 of this modified example may be applied to Embodiment 2.

Figure 9:
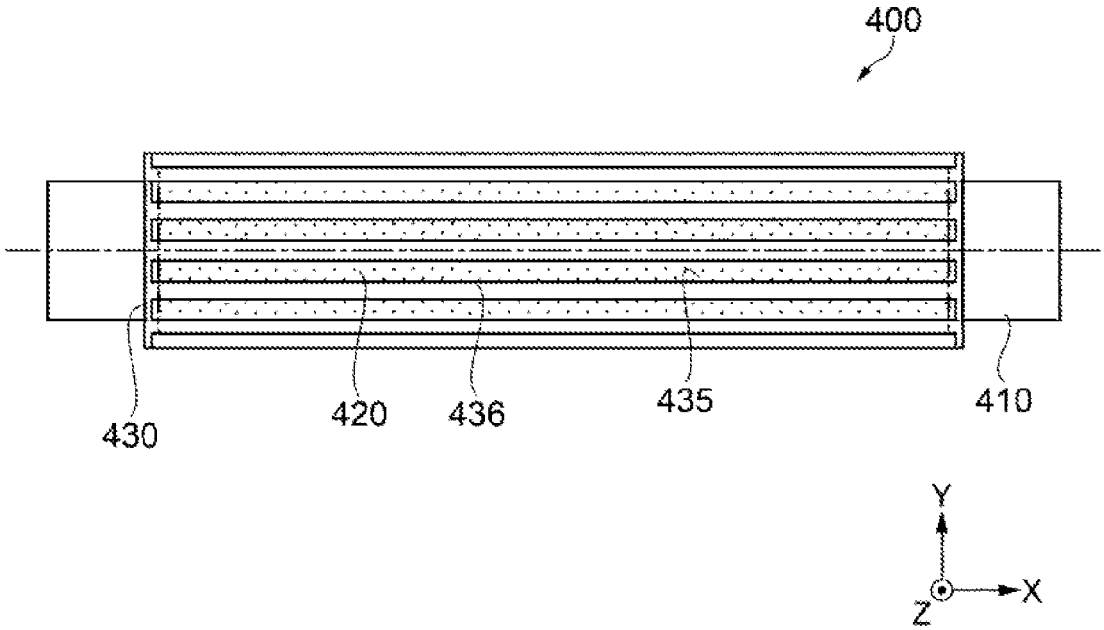
FIG. 9 is a schematic view illustrating a configuration of the support portion according to Modified Example 2.

(Modified Example 2) In Embodiment 1, the configuration is adopted in which the plurality of openings 135 are formed continuously, but the configuration is not limited thereto. For example, the openings may be configured to extend in one direction. FIG. 9 is a schematic view illustrating a configuration of the support portion (a medium guide mechanism) according to this modified example.

As illustrated in FIG. 9, a medium guide mechanism 400 includes a shaft member 410 that is provided across the width direction (the X axis direction) orthogonal to the transport direction of the medium M, and that guides the medium M in the transport direction, a static electricity eliminating material 420 provided covering the front surface of the shaft member 410, and a spacer 430 provided covering the front surface of the static electricity eliminating material 420. Note that the configuration of the shaft member 410 and the static electricity eliminating material 420 is the same as the configuration of Embodiment 1, and a description thereof will thus be omitted here.

The spacer 430 is a member that maintains a predetermined distance between the medium M and the static electricity eliminating material 420. As illustrated in FIG. 9, the spacer 430 is provided with rectangular openings 435 that extend in the X axis direction in plan view. Specifically, the openings 435 are formed extending between both end portions in the X axis direction of the spacer 430. Portions of the spacer 430 other than the openings 435 serve as a support face 436 that supports the medium M. Then, the openings 435 are aligned side by side in the Y axis direction (the transport direction), with the support face 436 therebetween. Here, the "Y axis direction" refers to a concept that includes not only an orthogonal coordinate system, but also a circumferential direction of the spacer 430 (i.e., a cylindrical coordinate system). In this way, when the medium M is transported while being supported by the support face 436, the second surface Mb of the medium M faces the static electricity eliminating material 420 without any margin, and therefore, the static electricity generated in the second surface Mb of the medium M is eliminated. Thus, with the configuration of this modified example also, similar effects as those described above can be obtained. Note that the configuration of the material of the spacer 430 and the like is the same as that of Embodiment 1. Further, the shape of the opening 435 of this modified example may be applied to Embodiment 2.

Figure 10:
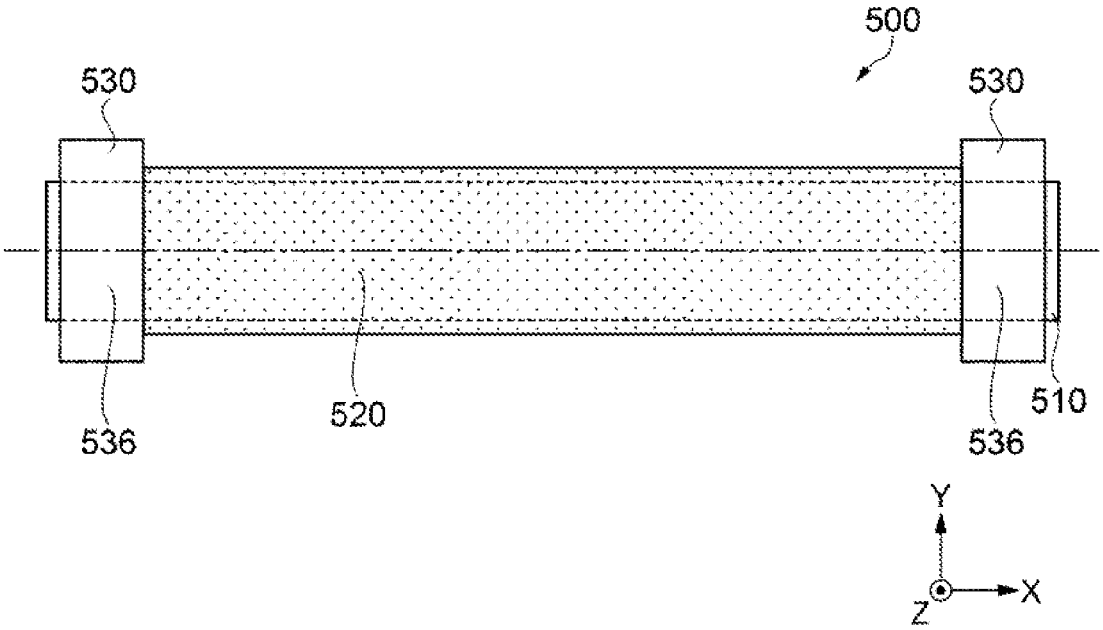
FIG. 10 is a schematic view illustrating a configuration of the support portion according to Modified Example 3.
Figure 11:
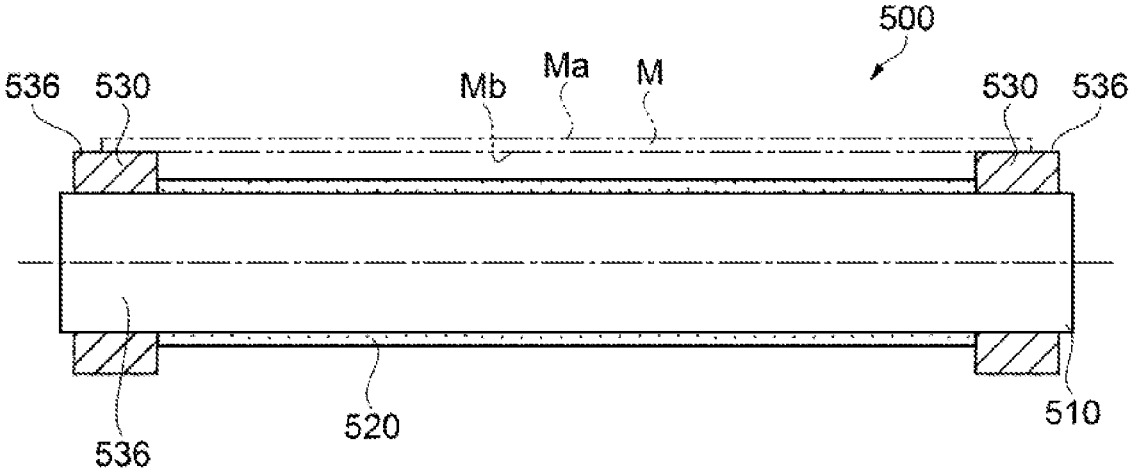
FIG. 11 is a schematic view illustrating the configuration of the support portion according to Modified Example 3.

(Modified Example 3) In Embodiment 1, the spacer 130 has the configuration covering the front surface of the static electricity eliminating material 120, but the configuration is not limited thereto. FIG. 10 and FIG. 11 are schematic diagrams illustrating a configuration of the support portion (a medium guide mechanism) according to this modified example. Specifically, FIG. 10 is a plan view and FIG. 11 is a cross-sectional view.

As illustrated in FIG. 10 and FIG. 11, a medium guide mechanism 500 includes a shaft member 510 that is provided across the width direction (the X axis direction) orthogonal to the transport direction of the medium M, and that guides the medium M in the transport direction, a static electricity eliminating material 520 provided covering the front surface of the shaft member 510, and spacers 530 provided on both ends of the shaft member in the X axis direction. Note that the configuration of the shaft member 510 and the static electricity eliminating material 520 is the same as the configuration of Embodiment 1, and a description thereof will thus be omitted here.

The spacers 530 are members that maintain a predetermined distance between the medium M and the static electricity eliminating material 520. Each of the spacers 530 is formed in a ring shape, covers the outer circumferential surface of both ends of the shaft 510, respectively, and has a constant thickness. The outermost circumferential surface of the spacer 530 serves as a support face 536 that supports the medium M. In this way, as illustrated in FIG. 11, when the medium M is transported while being supported by the support face 536, the second surface Mb of the medium M faces the static electricity eliminating material 520 except in the vicinity of the end portions, and thus, the static electricity generated in the second surface Mb of the medium M is eliminated. Thus, with the configuration of this modified example also, similar effects as those described above can be obtained. Note that the configuration of the material of the spacer 530 and the like is the same as that of Embodiment 1. Further, this modified example may also be applied to Embodiment 2, and the spacers may be provided only on both end portions, of the recessed portion of the first support portion 4, that are orthogonal to the transport direction of the medium M. In addition, a member that maintains the interval between the second surface Mb of the medium M and the static electricity eliminating material, such as the above-described spacer, may be omitted, and a configuration may be adopted in which the support portion 4 functions as the spacer, by generating a level difference between the front surface of the static electricity eliminating material disposed in the bottom portion of the recessed portion and the first support face 4*a* of the first support portion 4. Further, the spacer 530 may be configured to be movable in the X axis direction in accordance with the size of the width WM of the medium. In this case, after the spacer 530 is moved in the X axis direction in accordance with the size of the width WM of the medium, a regulating member may be provided that regulates the movement of the spacer 530 in the X axis direction. Further, the spacer 530 may be provided covering the front surface of the static electricity eliminating material 520.

Figure 12:
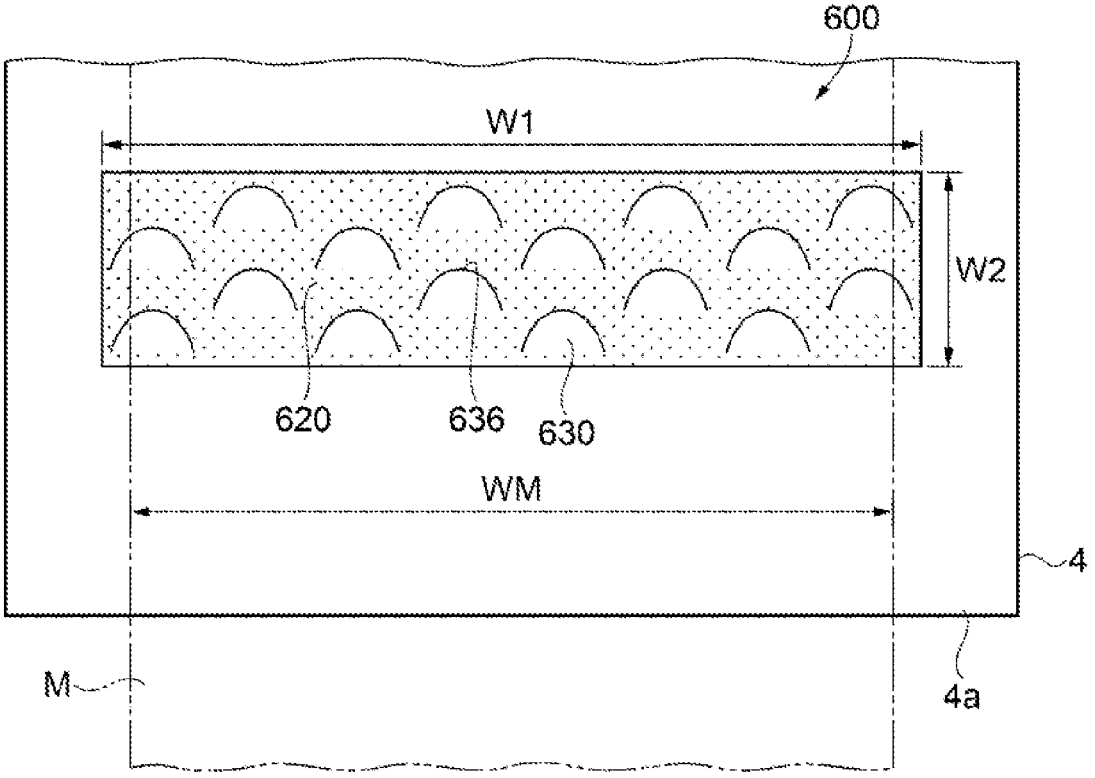
FIG. 12 is a schematic view illustrating a configuration of the support portion according to Modified Example 4.
Figure 13:
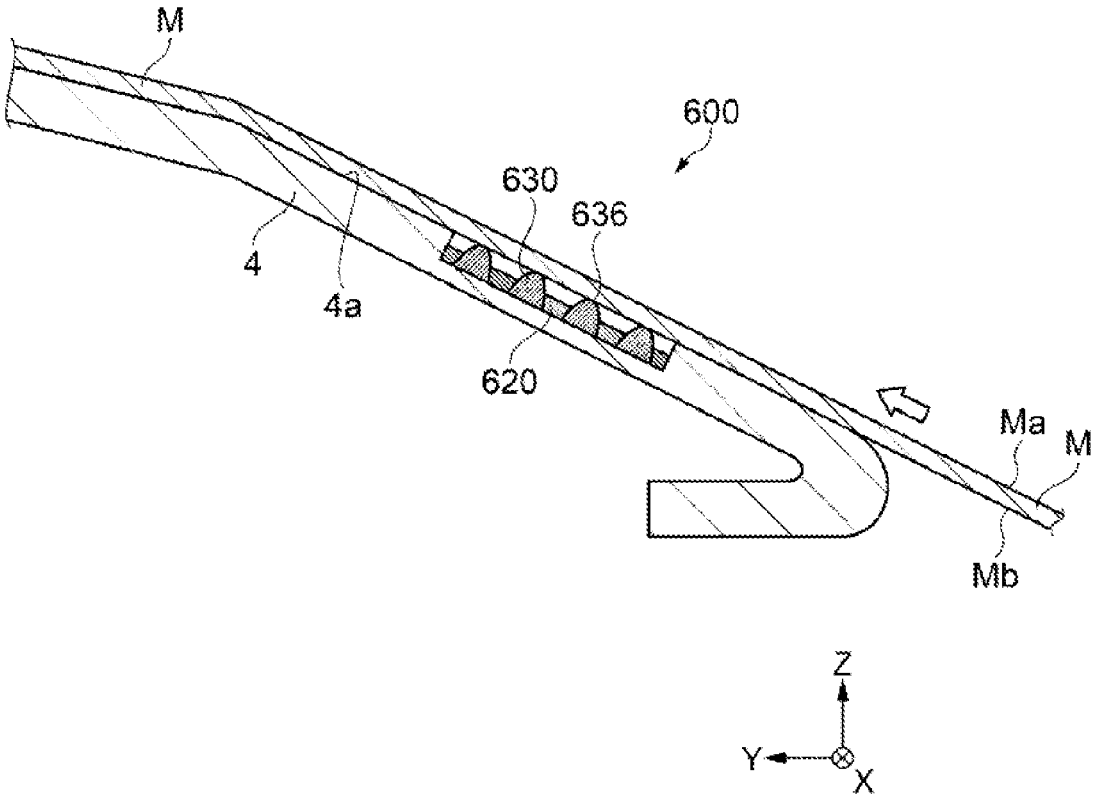
FIG. 13 is a schematic view illustrating the configuration of the support portion according to Modified Example 4.

(Modified Example 4) In Embodiment 2, the spacer 230 is provided so as to cover the static electricity eliminating material 220, but the configuration is not limited thereto. FIG. 12 and FIG. 13 are schematic diagrams illustrating a configuration of the support portion (the first support portion) according to this modified example.

As illustrated in FIG. 12 and FIG. 13, a static electricity eliminating portion 600 includes a static electricity eliminating material 620 and convex portions 630 provided on the first support portion 4.

The convex portions 630 are members that maintain a predetermined distance between the medium M and the static electricity eliminating material 620, and correspond to the function of the spacer 230 of Embodiment 2.

The plurality of convex portions 630 are provided in the recessed portion provided in the first support portion 4. Heights of each of the convex portions 630 are substantially the same, and a constant distance is provided between the adjacent convex portions 630. Then, a top surface (support face 636) of each of the convex portions 630 and the first support face 4*a* of the first support portion 4 are configured to be flush with each other. In this way, a difference in height on the surface that supports the medium M on the transport path does not easily occur, and the medium M is not easily damaged during transport.

Then, the static electricity eliminating material 620 is disposed between the convex portion 630 and the convex portion 630. As a result, when the medium M is transported while being supported by the top surfaces (the support faces 636) of the convex portions 630, the second surface Mb of the medium M and the static electricity eliminating material 620 face each other, and thus, the static electricity accumulated in the second surface Mb of the medium M is eliminated. Thus, with the configuration of this modified example also, similar effects as those described above can be obtained. Note that an example in which the convex portions 630 are provided on the first support portion 4 is illustrated, but the convex portions 630 may be provided on the static electricity eliminating material 620. Further, the convex portions 630 may be applied to Embodiment 1, and may be provided on a curved surface of the shaft member or on the static electricity eliminating material.

Note that the length dimension W1 in the direction orthogonal to the transport direction of the medium M of the recessed portion provided in the first support portion 4 is formed to be longer than the width dimension (the dimension along the X axis) WM of the medium M being transported. Therefore, the length dimension W1, in the direction orthogonal to the transport direction of the medium M, of the static electricity eliminating material 220 disposed in the bottom portion of the recessed portion is longer than the width dimension (the dimension along the X axis) WM of the medium M being transported. In addition, the length dimension W2 in the transport direction of the medium M of the recessed portion provided in the first support portion 4 is approximately ⅓ to half the width dimension (the dimension along the X axis) of the medium M being transported.

Figure 14:
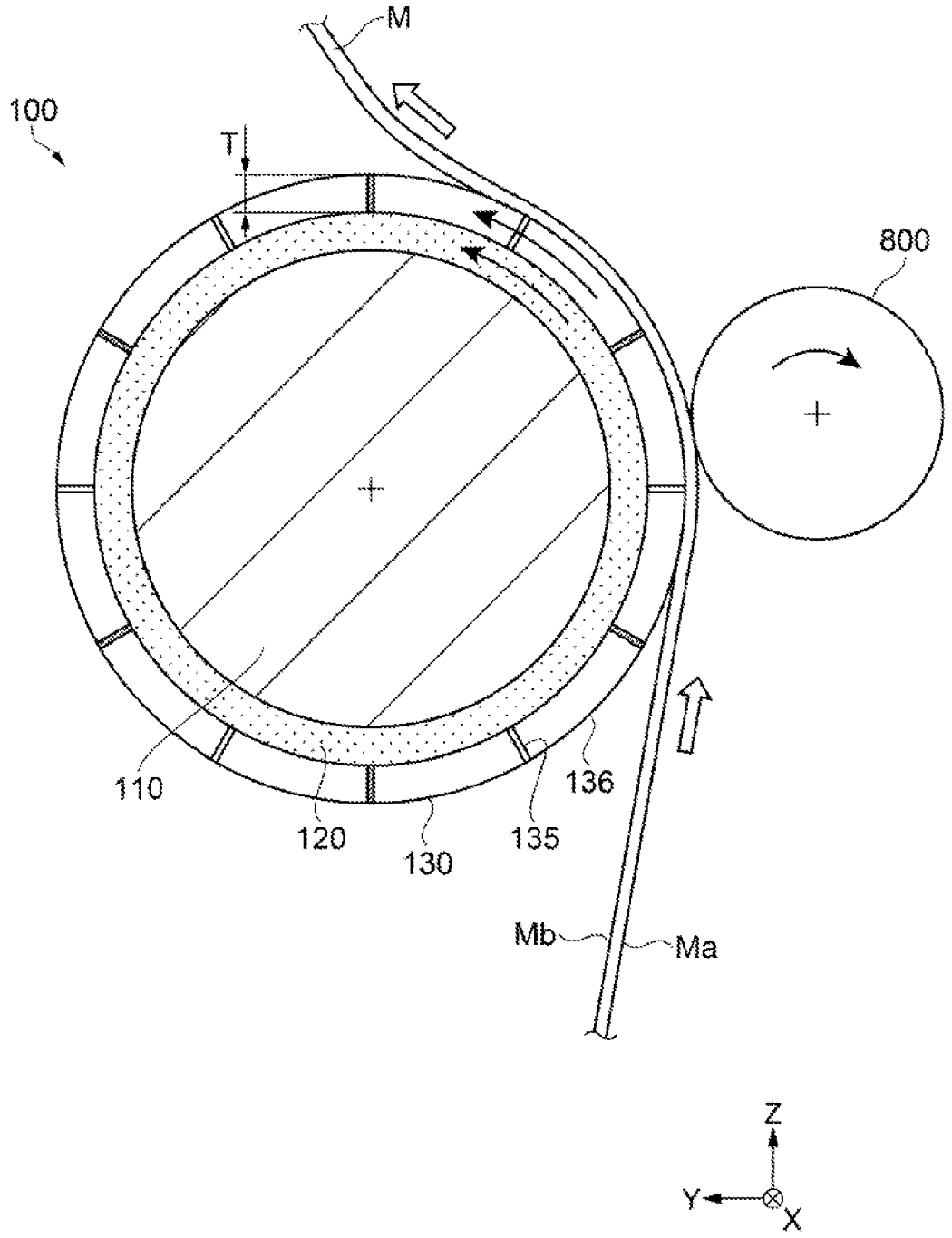
FIG. 14 is a schematic view illustrating a configuration of a pressing device according to Modified Example 5.

(Modified Example 5) In Embodiment 1, the pair of transport rollers 23 and the roll unit 21 are applied as the pressing device, but the configuration is not limited thereto. FIG. 14 is a schematic view illustrating a configuration of a pressing device according to this modified example. As shown in FIG. 14, in this modified example, a roller 800 is provided as the pressing device, and the roller 800 is disposed so as to press the medium guide mechanism 100 through the medium M. The roller 800 is a driven roller. In this way, the medium M is transported while being nipped by the medium guide mechanism 100 and the roller 800, and at this time, the spacer 130 and static electricity eliminating material 120 of the medium guide mechanism 100 are pressed against the roller 800. As a result, the static electricity eliminating material 120 and the spacer 130 are in close contact with each other, making it easier to rotate the static electricity eliminating material 120 and the spacer 130 simultaneously with respect to the shaft member 110. Therefore, sliding wear between the static electricity eliminating material 120 and the spacer 130 is reduced, and the functional life of the static electricity eliminating material 120 can be further extended.

Note that, for example, a magnet may be used as another pressing device. Specifically, a magnet (a permanent magnet, for example) is disposed inside the shaft member 110, and a magnetic body is disposed on a portion of the spacer 130. In this way also, because the spacer 130 comes into close contact with the static electricity eliminating material 120 as the spacer 130 is attracted toward the shaft member 110, sliding between the static electricity eliminating material 120 and the spacer 130 does not easily occur, and sliding wear between the static electricity eliminating material 120 and the spacer 130 is reduced.

Figure 15:
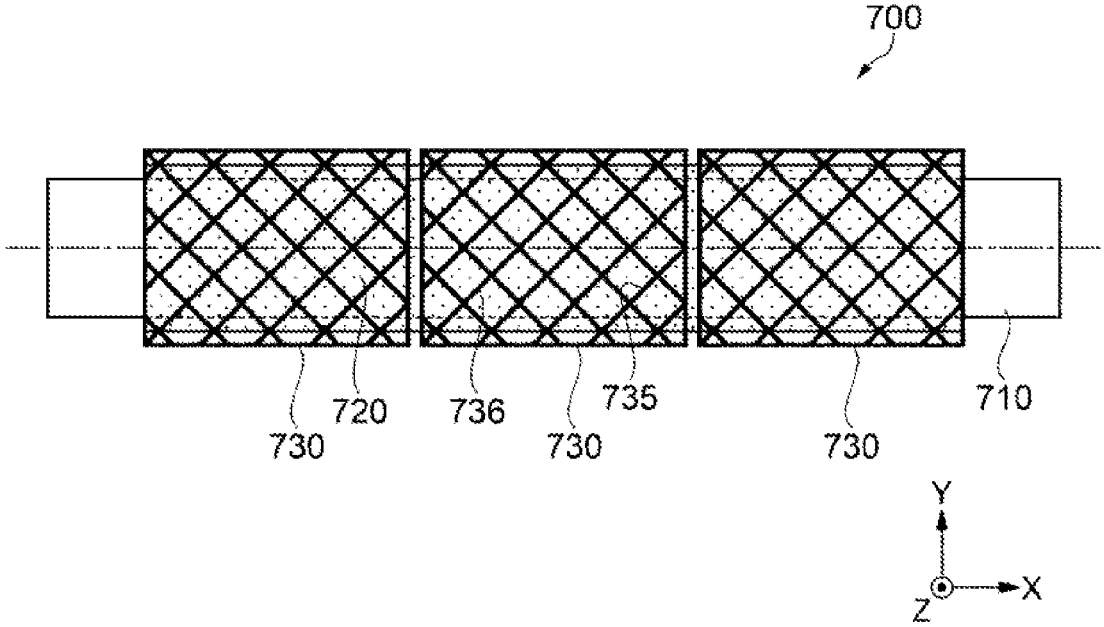
FIG. 15 is a schematic view illustrating a configuration of the support portion according to Modified Example 6.

(Modified Example 6) In Embodiment 1, the medium guide mechanism 100 is configured by the single spacer 130, but the configuration is not limited thereto. A spacer may be provided in a state of being divided in the width direction. FIG. 15 is a schematic view illustrating a configuration of the support portion (a medium guide mechanism) according to this modified example.

As illustrated in FIG. 15, a medium guide mechanism 700 includes a shaft member 710 that is provided across the width direction (the X axis direction) orthogonal to the transport direction of the medium M, and that guides the medium M in the transport direction, a static electricity eliminating material 720 provided covering the front surface of the shaft member 710, and spacers 730 provided covering the front surface of the static electricity eliminating material 720. Note that the configuration of the shaft member 710 and the static electricity eliminating material 720 is the same as the configuration of Embodiment 1, and a description thereof will thus be omitted here.

Then, the spacers 730 are provided while being divided from each other in the width direction (the X axis direction) orthogonal to the transport direction of the medium M. In other words, the plurality of spacers 730 are provided across the width direction (the X axis direction) orthogonal to the transport direction of the medium M. Further, a plurality of openings 735 are formed in each of the spacers 730. Note that the remaining configuration of the spacer 730 is the same as the configuration of Embodiment 1, and a description thereof will thus be omitted here.

For example, when there is torsion or the like in the shaft member 710 due to an assembly error, the static electricity eliminating material 720 may also have projections and depressions following the shape of the torsion of the shaft member 710. At this time, the distance between the second surface Mb of the medium M and the static electricity eliminating material 720 is not uniform over the width direction of the uneven shape with the projections and depressions of the static electricity eliminating material 720, and when a wide medium is used as the medium M, in particular, this non-uniformity clearly appears. As a result, a degree of destaticization over the width direction may vary.

Even in this type of case, since the spacers 730 are provided while being divided from each other in the width direction, it becomes easier for the spacers 730 to conform to the projections and depressions of the static electricity eliminating material 720 and to be in close contact with the static electricity eliminating material 720, and the distance between the medium M and the static electricity eliminating material 720 can be uniformly maintained. In this way, it is possible to suppress non-uniformity in the effect of destaticizing the medium in the width direction. Further, because the spacers 730 can rotate at different circumferential speeds from each other with respect to the shaft member 710, transport errors of the medium M in the width direction can be mitigated.

Figure 16:
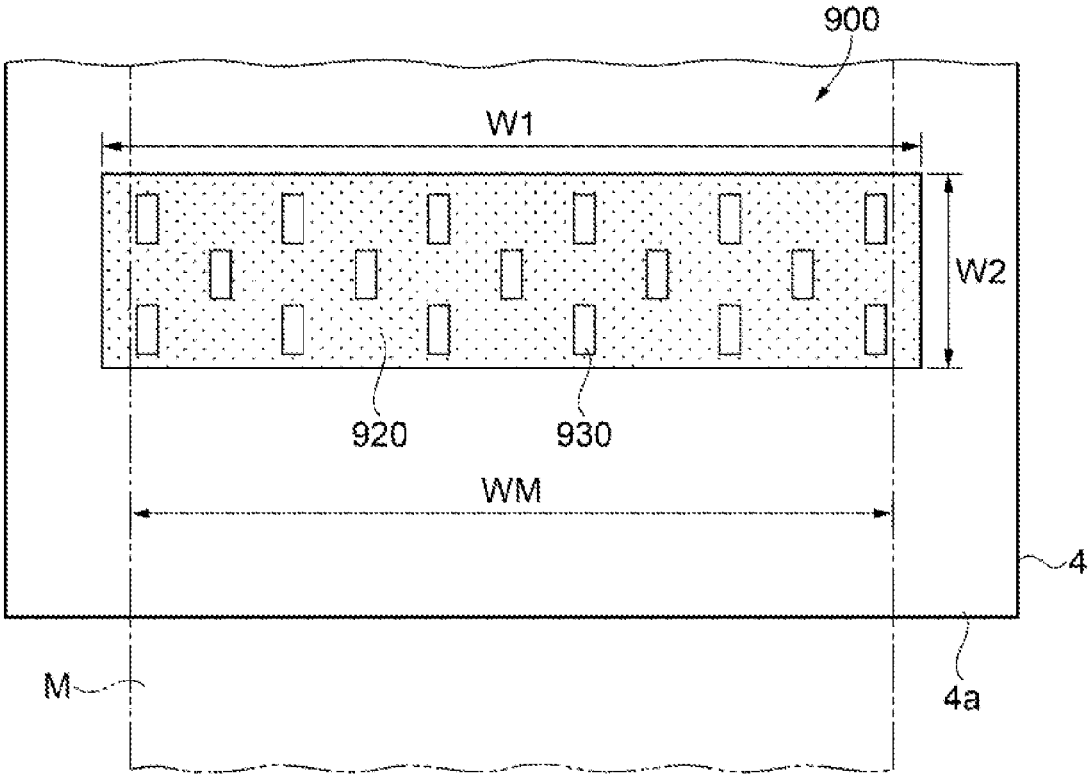
FIG. 16 is a schematic view illustrating a configuration of the support portion according to Modified Example 7.
Figure 17:
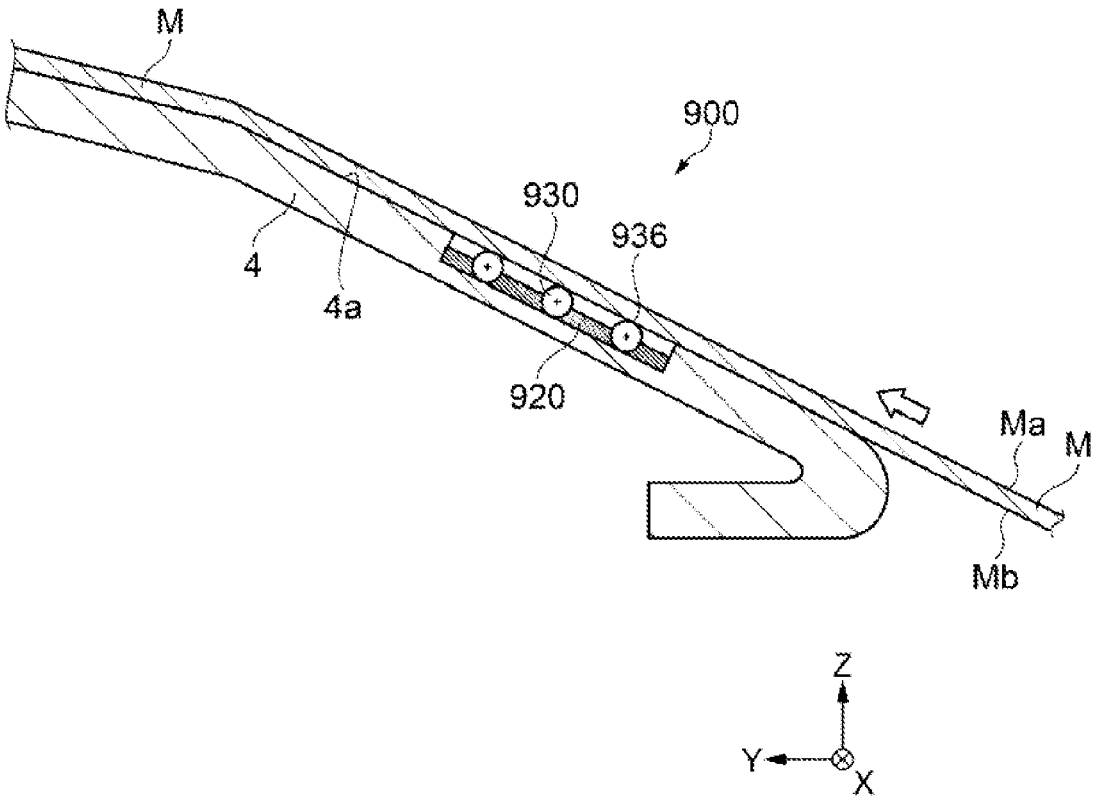
FIG. 17 is a schematic view illustrating the configuration of the support portion according to Modified Example 7.

(Modified Example 7) In Embodiment 2, the spacer 230 is provided so as to cover the static electricity eliminating material 220, but the configuration is not limited thereto. FIG. 16 and FIG. 17 are schematic diagrams illustrating a configuration of the support portion (the first support portion) according to this modified example. In detail, FIG. 16 is a plan view and FIG. 17 is a side cross-sectional view.

As illustrated in FIG. 16 and FIG. 17, a static electricity eliminating portion 900 includes a static electricity eliminating material 920 and rollers 930 provided on the first support portion 4.

Each of the rollers 930 is a member that maintains a predetermined distance between the medium M and the static electricity eliminating material 920, and corresponds to the function of the spacer 230 of Embodiment 2.

The plurality of rollers 930 are provided in the recessed portion provided in the first support portion 4. As illustrated in FIG. 17, a height of each of the rollers 930 is substantially the same, and a constant distance is provided between the adjacent rollers 930. Then, top surfaces (support faces 936) of the rollers 930 and the first support face 4*a* of the first support portion 4 are configured to be flush with each other. In this way, a difference in height on the surface that supports the medium M on the transport path does not easily occur, and the medium M is not easily damaged during transport.

Then, the static electricity eliminating material 920 is disposed between the roller 930 and the roller 930. In this way, when the medium M is transported while being supported by the top surfaces (the support faces 936) of the rollers 930, the second surface Mb of the medium M and the static electricity eliminating material 920 face each other, and thus, the static electricity accumulated in the second surface Mb of the medium M is eliminated. Thus, with the configuration of this modified example also, similar effects as those described above can be obtained.

Note that the length dimension W1, in the direction orthogonal to the transport direction of the medium M, of the recessed portion provided in the first support portion 4 is formed to be longer than the width dimension (the dimension along the X axis) WM of the medium M being transported. Therefore, the length dimension W1, in the direction orthogonal to the transport direction of the medium M, of the static electricity eliminating material 220 disposed in the bottom portion of the recessed portion is longer than the width dimension (dimension along the X axis) WM of the medium M being transported. Further, the length dimension W2, in the transport direction of the medium M, of the recessed portion provided in the first support portion 4 is approximately ⅓ to half the width dimension (the dimension along the X axis) of the medium M being transported.

Figure 18:
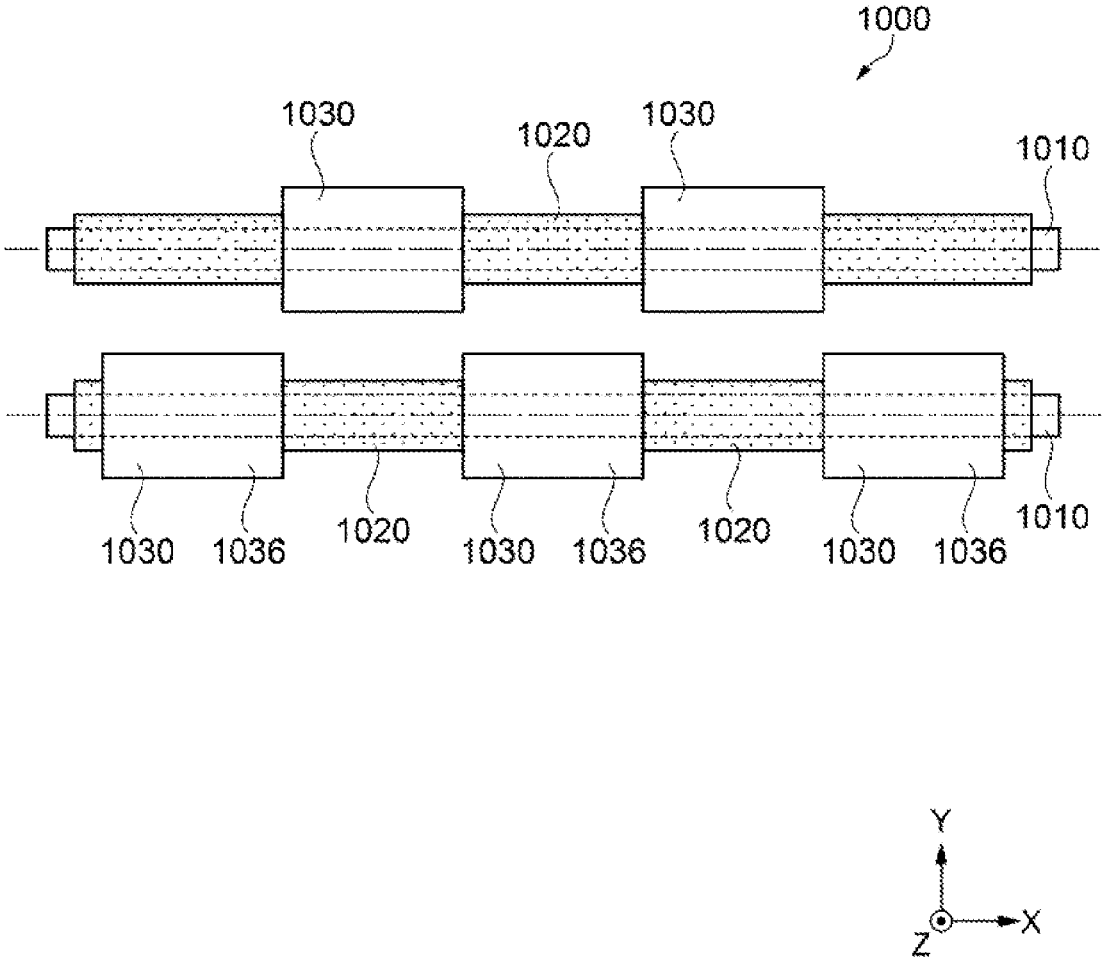
FIG. 18 is a schematic view illustrating a configuration of the support portion according to Modified Example 8.

(Modified Example 8) In Embodiment 2, the static electricity eliminating portion 200 is provided on the first support portion 4, but the configuration is not limited thereto. FIG. 18 is a schematic view illustrating a configuration of the support portion according to this modified example.

As illustrated in FIG. 18, a static electricity eliminating portion 1000 includes a plurality of shaft members 1010 (two in this modified example) that are provided across the width direction (the X axis direction) orthogonal to the transport direction of the medium M, and that guide the medium M in the transport direction. The shaft members 1010 are disposed in parallel to each other in the Y axis direction (the transport direction of the medium M). A front surface of each of the shaft members 1010 is covered by a static electricity eliminating material 1020. In addition, a plurality of rollers 1030 are disposed so as to cover a front surface of the static electricity eliminating material 1020.

Then, the static electricity eliminating portion 1000 is disposed at a position other than the first support portion 4. For example, the static electricity eliminating portion 1000 is disposed on the transport path of the medium M between the roll unit 21 and the first support portion 4.

The rollers 1030 are members that maintain a predetermined distance between the medium M and the static electricity eliminating material 1020. In addition, front surfaces (outer circumferential surfaces) of the rollers 1030 serve as a support face 1036 that supports the medium M. Then, as illustrated in FIG. 18, the rollers 1030 provided on each of the shaft members 1030 are disposed in a staggered manner between the shaft members 1030. In other words, the rollers 1030 are disposed such that the support face 1036 does not extend continuously in at least the Y axis direction (the transport direction). Here, the "Y axis direction" refers to a concept that includes not only an orthogonal coordinate system, but also a circumferential direction (i.e., a cylindrical coordinate system) of the rollers 1030. As a result, when the medium M is transported on the support faces 1036 of the rollers 1030, the second surface Mb of the medium M faces the static electricity eliminating material 1020 without any margin, and therefore, the static electricity accumulated in the second surface Mb of the medium M is eliminated. Thus, with the configuration of this modified example also, similar effects as those described above can be obtained.

The static electricity eliminating portion 1000 according to this modified example may be configured such that only the roller 1030 is rotatable with respect to the shaft 1010, or may be configured such that the roller 1030 rotates synchronously with the rotation of the shaft 1010. Further, the shaft members 1010 and the rollers 1030 may be fixed and not rotate with respect to the printing apparatuses 1 and 1A.

Note that the static electricity eliminating portion 1000 of this modified example may be applied alone in the printing apparatus, or may be applied in combination with the configuration of each of the embodiments and each of the modified examples described above.

(Modified Example 9) In Embodiment 1, the static electricity eliminating material 120 and the spacer 130 are configured so as to be rotatable relative to each other, but the configuration is not limited thereto. For example, the static electricity eliminating material 120 and the spacer 130 may be adhered to each other, and the static electricity eliminating material 120 and the spacer 130 may be integrally formed so as to be able to move with respect to the circumferential surface of the shaft member 110. In this way, for example, the friction between the static electricity eliminating material 120 and the spacer 130 is reduced and deterioration of the static electricity eliminating material 120 can be inhibited even in a printing apparatus in which it is difficult to apply tension to the medium M, such as a printing apparatus that prints on single sheets of paper, a printing apparatus provided with a cutter that cuts a printed medium, or the like.

(Modified Example 10) The medium guide mechanisms 100, 300, 400, 500, and 700, and the static electricity eliminating portions 200, 600, and 900 use the static electricity eliminating material in a non-contact manner, but a contact type destaticizing wire or the like may be used.

(Modified Example 11) The printing apparatuses 1, and 1A may be provided with a combination of the medium guide mechanisms 100, 300, 400, 500, and 700 and the static electricity eliminating portions 200, 600, and 900 as appropriate.

(Modified Example 12) The printing apparatuses 1 and 1A according to Embodiments 1 and 2 have the configuration including the carriage 32 capable of causing the printing head 31 to scan, but the configuration is not limited to this example. For example, a configuration may be adopted in which the droplets can be ejected across the width direction of the medium M without causing the printing head 31 to scan. At this time, the printing head is a so-called line head in which a nozzle row is formed along the width direction of the medium M. Even with this configuration, similar effects as those described above can be obtained.

(Modified Example 13) As the printing apparatuses 1 and 1A of Embodiments 1 and 2, a liquid ejection device that sprays or ejects liquid other than ink may be employed. For example, the liquid ejection device can be used in a variety of printing apparatuses provided with heads for ejecting small quantities of droplets and the like. Note that "droplets" refer to the state of the liquid ejected from the above-described printing apparatus, and include liquids that leave granular, tear-shaped, or string-like traces. Further, it is sufficient that the liquid referred to here be a material that can be ejected (sprayed) from the liquid ejection device. For example, it is sufficient that a substance be in a state of a liquid phase, such as a liquid body with high or low viscosity, a fluid mode such as sol, gel water, other inorganic solvents, organic solvents, solutions, liquid resins, liquid metals (metallic melt), or a substance that is a liquid in one state, and not only these, but may also be a liquid in which particles of functional materials formed of solid materials such as pigments and metallic particles are dissolved, dispersed, or mixed in a solvent, or the like. Further, representative examples of the liquids include the ink as described in the above embodiments. Here, the ink is assumed to include various types of liquid compounds, such as general water-based ink and oil-based ink, as well as gel ink, hot-melt ink, and the like. Further, addition to the plastic film such as a vinyl chloride film or the like, the medium M is assumed to include thin thermal expansion functional paper, a textile such as cloth or fabric, a substrate, a metal plate, or the like.

Further, the disclosure can also be applied to a printing apparatus that uses a device other than a device that ejects the liquid to perform the printing. Furthermore, the disclosure can be applied not only to a printing apparatus, but also to a transport device that transports a medium while eliminating static electricity.

REFERENCE SIGNS LIST

1, 1A . . . Printing apparatus, 2 . . . Transport unit, 3 . . . Printing unit, 4 . . . First support portion, 4*a* . . . First support face, 5 . . . Second support portion, 5*a* . . . Second support face, 6 . . . Third support portion, 6*a* . . . Third support face, 31 . . . Printing head, 50 . . . Tension adjustment unit, 100 . . . Medium guide mechanism, 110 . . . Shaft member, 120 . . . Static electricity eliminating material, 130 . . . Spacer, 135 . . . Opening, 136 . . . Support face, 200 . . . Static electricity eliminating portion, 220 . . . Static electricity eliminating material, 230 . . . Spacer, 235 . . . Opening, 236 . . . Support face, 300 . . . Medium guide mechanism, 310 . . . Shaft member, 320 . . . Static electricity eliminating material, 330 . . . Spacer, 335 . . . Opening, 336 . . . Support face, 400 . . . Medium guide mechanism, 410 . . . Shaft member, 420 . . . Static electricity eliminating material, 430 . . . Spacer, 435 . . . Opening, 436 . . . Support face, 500 . . . Medium guide mechanism, 510 . . . Shaft member, 520 . . . Static electricity eliminating material, 530 . . . Spacer, 536 . . . Support face, 600 . . . Static electricity eliminating portion, 620 . . . Static electricity eliminating material, 630 . . . Convex portion, 700 . . . Medium guide mechanism, 710 . . . Shaft member, 720 . . . Static electricity eliminating material, 730 . . . Spacer, 735 . . . Opening, 800 . . . Roller, 900 . . . Static electricity eliminating portion, 920 . . . Static electricity eliminating material, 930 . . . Roller, 1000 . . . Static electricity eliminating portion, 1010 . . . Shaft member, 1020 . . . Static electricity eliminating material, 1030 . . . Roller, 1036 . . . Support face, M . . . Medium, Ma . . . First surface, Mb . . . Second surface The present application is a 371 nationalization of international patent application number PCT/JP2018/029571, filed Aug. 7, 2018, which claims priority to Japanese patent application number 2017-155112, filed Aug. 10, 2017, the disclosures of which are hereby incorporated herein in their entirety.

The invention claimed is:

1. A printing apparatus comprising:

a printing head configured to perform printing in a printing region of a first surface of a medium;

a support portion configured to support a second surface of the medium;

a transport unit configured to transport the medium in a transport direction; and a static electricity eliminating material provided facing the second surface, wherein the support portion includes a spacer configured to maintain a predetermined distance between the medium and the static electricity eliminating material, the support portion includes a medium guide mechanism including a shaft member provided across over a width direction orthogonal to the transport direction and configured to guide the medium in the transport direction and the static electricity eliminating material is provided covering a front surface of the shaft member, the printing apparatus further comprises a pressing device configured to press, through the spacer, the static electricity eliminating material toward the shaft member, wherein when a frictional coefficient between the shaft member and the static electricity eliminating material is a first frictional coefficient, a frictional coefficient between the static electricity eliminating material and the spacer is a second frictional force, and a frictional coefficient between the spacer and the second surface is a third frictional force, the second frictional coefficient is greater than the first frictional coefficient and the third frictional coefficient.

2. The printing apparatus according to claim 1, wherein the support portion includes a platen configured to support at least the printing region, from the second surface side, and the medium guide mechanism is provided upstream of the platen in the transport direction.

3. The printing apparatus according to claim 2, wherein the spacer is provided facing both the second surface and the static electricity eliminating material, and an opening exposing the static electricity eliminating material to the second surface is provided in the spacer.

4. The printing apparatus according to claim 1, wherein the spacer is provided facing both the second surface and the static electricity eliminating material, and an opening exposing the static electricity eliminating material to the second surface is provided in the spacer.

5. The printing apparatus according to claim 1, wherein the third frictional coefficient is greater than the first frictional coefficient.

6. The printing apparatus according to claim 5, wherein the spacer is provided in a manner of being divided in the width direction.

7. The printing apparatus according to claim 5, wherein the spacer is provided facing both the second surface and the static electricity eliminating material, and an opening exposing the static electricity eliminating material to the second surface is provided in the spacer.

8. The printing apparatus according to claim 1, wherein the third frictional coefficient is less than the first frictional coefficient.

9. The printing apparatus according to claim 8, wherein the spacer is provided in a manner of being divided in the width direction.

* * * * *